US007687005B2

(12) United States Patent
Skidmore et al.

(10) Patent No.: US 7,687,005 B2
(45) Date of Patent: Mar. 30, 2010

(54) MASONRY UNIT MANUFACTURING METHOD

(75) Inventors: David A. Skidmore, Bluefield, VA (US); James B. Link, Abingdon, VA (US)

(73) Assignee: E. Dillon & Company, Swords Creek, VA (US)

( * ) Notice: Subject to any disclaimer, the term of this patent is extended or adjusted under 35 U.S.C. 154(b) by 1347 days.

(21) Appl. No.: 10/632,491

(22) Filed: Jul. 31, 2003

(65) Prior Publication Data

US 2004/0130047 A1 Jul. 8, 2004

Related U.S. Application Data

(60) Provisional application No. 60/437,947, filed on Jan. 2, 2003.

(51) Int. Cl.
*B28B 3/00* (2006.01)
*B28B 7/20* (2006.01)
*E04C 1/00* (2006.01)

(52) U.S. Cl. ..... 264/333; 264/297.9; 425/253; 425/434

(58) Field of Classification Search ..... 264/33, 264/333, 297.9; 425/431, 434, 253, 469
See application file for complete search history.

(56) References Cited

U.S. PATENT DOCUMENTS

| | | | | | |
|---|---|---|---|---|---|
| 1,494,953 | A | * | 5/1924 | Cross | 425/431 |
| 1,872,522 | A | * | 8/1932 | Stuckey | 264/157 |
| 2,475,435 | A | * | 7/1949 | Rasmussen | 249/140 |
| 2,532,049 | A | * | 11/1950 | Wittke | 425/424 |
| 2,696,729 | A | * | 12/1954 | Vander Heyden | 52/223.7 |
| 3,509,250 | A | * | 4/1970 | Knipper | 264/219 |
| 3,662,438 | A | * | 5/1972 | Koyama | 425/186 |
| 4,802,836 | A | * | 2/1989 | Whissell | 425/253 |
| 4,856,976 | A | * | 8/1989 | Rook et al. | 425/330 |
| 5,139,721 | A | | 8/1992 | Castonguay et al. | 264/71 |
| 5,358,214 | A | | 10/1994 | Batlle | 249/142 |
| 6,113,379 | A | * | 9/2000 | LaCroix et al. | 425/443 |
| 6,322,742 | B1 | | 11/2001 | Bott | 264/297.9 |

* cited by examiner

*Primary Examiner*—Matthew J. Daniels

(57) ABSTRACT

A method for forming a masonry unit that includes joining a pallet to a bottom surface of a mold, inserting a filler plug into the side of the mold between a partition plate and a pallet, dispensing mix into the mold, and compressing the mix with a shoe to form a masonry unit with a filler plug effect.

21 Claims, 17 Drawing Sheets

MASONRY UNIT MANUFACTURING METHOD

CROSS-REFERENCE TO RELATED APPLICATIONS

This application claims the benefit of U.S. Provisional Application No. 60/437,947, filed Jan. 2, 2003, which is entirely incorporated herein by reference.

This application is related to U.S. Utility application entitled "MASONRY UNITS WITH A MORTAR BUFFER", Ser. No. 10/632,490, filed on Jul. 31, 2003, which is entirely incorporated herein by reference.

TECHNICAL FIELD

The present invention is generally related to construction products, and, more particularly, is related to manufacturing methods for masonry units.

BACKGROUND OF THE INVENTION

Masonry units include concrete masonry units and bricks that are stacked together and mortared to produce structures, such as building walls. Concrete masonry units (CMUs) include building blocks that are comprised of a mixture of aggregates, cement or other bonding agents, and other components such as admixtures. Over the years, methods for manufacturing CMUs have improved to produce CMUs that meet or exceed architectural aesthetic requirements and performance characteristics, such as those requirements developed by the National Concrete Masonry Association (NCMA), American Society for Testing and Materials (ASTM), among others. For example, architectural concrete masonry units (ACMUs), which include CMUs that meet or exceed the structural criteria for CMUs (e.g., load-bearing strength of 1000 pounds per square inch (PSI) for building blocks) in addition to exhibiting added aesthetic features (e.g., pigmentation), are available with more precise cuts, polished surfaces, and larger sizes that provide a sophisticated appearance that resembles marble or granite more than conventional basement blocks. Further, specially formulated aggregates and sealants are included in the manufacturing process to provide ACMUs with low absorption characteristics, enabling better weather and/or freeze/thaw resistance.

Despite these advances, walls constructed with CMUs still present challenges to masons and manufacturers of CMUs in their efforts to provide attractive finishes to buildings. In particular, mortar joints (e.g., the mortared area sandwiched between adjacent CMUs) have remained largely unimproved. During the installation of CMUs and or other masonry units such as bricks, edges are chipped and/or mortar is smeared on CMU (or brick) surfaces, often resulting in additional labor to clean the surfaces and the failure to meet the expectations of the owner or architect. Thus, a need exists in the industry to manufacture masonry units which enable improved mortar joints that address the aforementioned and/or other deficiencies and/or inadequacies.

SUMMARY OF THE INVENTION

Among other embodiments, preferred embodiments of the present invention provide a method for forming a masonry unit that includes joining a pallet to a bottom surface of a mold, inserting a filler plug into the side of the mold between a partition plate and a pallet, dispensing mix into the mold, and compressing the mix with a shoe to form a masonry unit with a filler plug effect.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

The preferred embodiments of the invention now will be described more fully hereinafter with reference to the accompanying drawings. In particular, the preferred embodiments of the present invention include masonry unit (MU) manufacturing methods and in particular, MU manufacturing methods that form multiple bevel surfaces or other geometric surface that at least partially surrounds one or more surfaces of the MU. Masonry units include concrete masonry units (CMUs) installed with mortar and other machine-manufactured products that are installed with mortar, such as fire-kilned, clay bricks, as well as bricks made with other constituents. Other embodiments include masonry units that are not installed with mortar. Further, CMUs included within the scope of the preferred embodiments of the invention include architectural concrete masonry units (ACMUs). ACMUs meet or exceed the structural specifications of CMUs in addition to including added aesthetic features, such as pigmentation, surface texture, fracturing, serrating, grinding, polishing, selection of aggregates, etc. CMUs or ACMUs that are used with mortar are to be distinguished from blocks used in segmented retaining walls (SRWs), which include landscape blocks and other blocks that are dry-stacked (e.g., installed without the use of mortar), and which also are included within the scope of the manufacturing methods of the preferred embodiments of the invention. Although masonry units such as bricks and CMUs (e.g., basement blocks) that are installed with or without mortar are understood as being within the scope of the preferred embodiments of the invention, the preferred embodiments of the invention will herein be described in the context of manufacturing methods for ACMUs having a peripheral mortar buffer. Further, the preferred embodiments of the invention will be described in the context of a manufacturing process characterized by pneumatic, hydraulic, and/or electrical control and/or actuation, with the understanding that other embodiments can incorporate mechanical control and/or actuation in addition to and/or in lieu of hydraulic and/or pneumatic control and/or actuation.

The ACMU manufacturing methods include several components for forming a mortar buffer (or plurality of mortar buffers), including a mold configured with gussets to form the side mortar buffer surfaces, a shoe assembly to form the top mortar buffer surface, and a retractable filler plug that is used to form the bottom mortar buffer surface.

Figure 1:
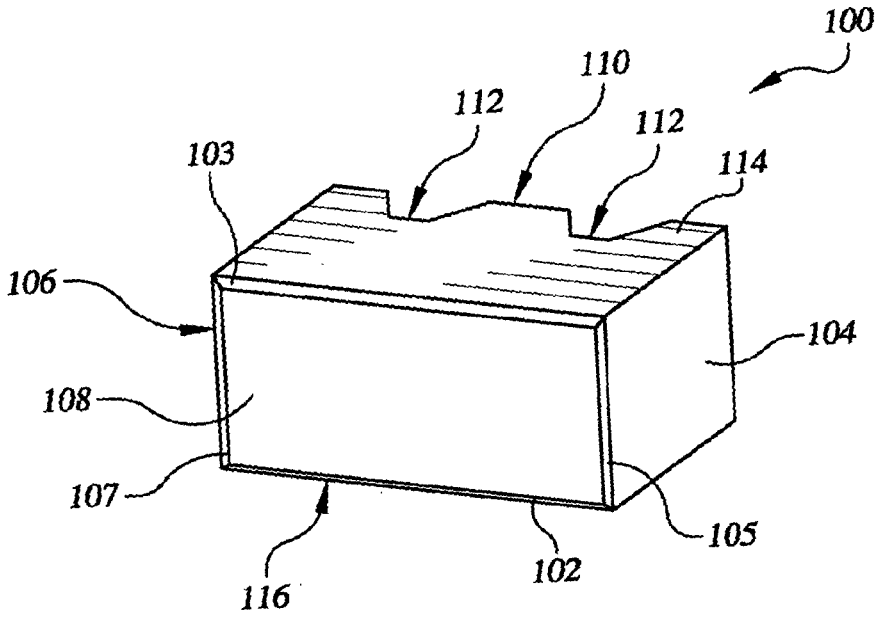
FIG. 1 is a front perspective view of an example smooth-face architectural masonry unit (ACMU) with a mortar buffer around the front surface, in accordance with one embodiment of the invention.
Figure 2:
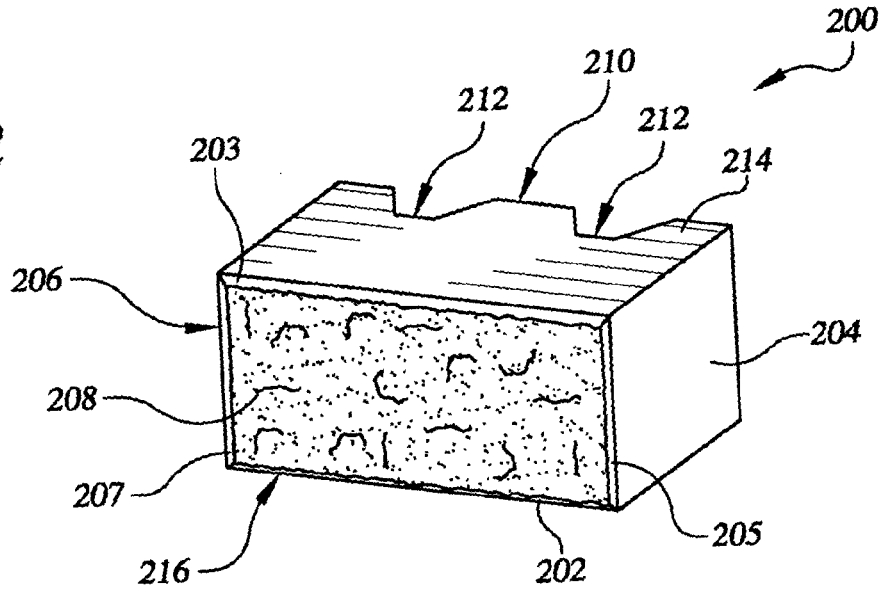
FIG. 2 is a front perspective view of an example split-face ACMU with a mortar buffer around the front surface, in accordance with one embodiment of the invention.

FIGS. 1 and 2 show two example ACMUs configured with a mortar buffer. FIGS. 3 and 4 are used to illustrate manufacturing components and manufacturing steps of the preferred embodiments, with FIG. 5A serving as an illustration of some select components used in the manufacturing process. FIGS. 6-11 present these select components in further detail, followed by a flowchart in FIG. 12 that describes one method in accordance with the preferred embodiments of the invention. FIGS. 13-15 provide some example filler plug embodiments and cooperating elements for providing corner beveled surfaces.

The preferred embodiments of the invention may, however, be embodied in many different forms and should not be construed as limited to the embodiments set forth herein; rather, these embodiments are provided so that this disclosure will be thorough and complete, and will fully convey the scope of the invention to those having ordinary skill in the art. For example, although the ACMUs formed by the ACMU manufacturing methods described and shown herein are of a generally rectangular, box-like shape, the formation of other geometrical shapes is understood to be within the scope of the preferred embodiments of the invention, including the formation of ACMUs having a trapezoidal or square shape, among other shapes. Also, ACMUs formed herein by the ACMU manufacturing methods will be shown primarily with core areas shown at the back surfaces, with the understanding that core areas can be formed in the middle of each ACMU or elsewhere in some embodiments, or omitted altogether in other embodiments. Further, although a mortar buffer is shown to be formed by the ACMU manufacturing methods around the periphery of the front surface of an ACMU, other surfaces that are parallel (or otherwise) to a plane that will receive mortar, or not, will likewise benefit from a peripheral mortar buffer and thus be within the scope of the preferred embodiments of the invention. Furthermore, all "examples" given herein are intended to be non-limiting, and are included as examples among many others contemplated and within the scope of the invention.

FIG. 1 is a front perspective view of an example ACMU 100 with beveled surfaces of a mortar buffer, in accordance with one embodiment of the invention. The ACMU 100 includes a front surface 108 that is surrounded by the mortar buffer, the mortar buffer comprising a bottom mortar buffer surface 102, a first side mortar buffer surface 105, a top mortar buffer surface 103, and a second side mortar buffer surface 107. Additionally, the ACMU 100 includes a first side surface 104 and a second side surface 106 opposing the first side surface 104, and outside back surfaces 110. The front surface 108, in one embodiment, can be a standard concrete masonry finish (e.g., produced with a grit level of less than approximately 80), or in other embodiments can be polished smooth to have an appearance similar to that of stone, such as marble or granite (e.g., produced with a grit level of approximately 80 or more). The back surfaces 110 are further delineated by core areas 112. The ACMU 100 also includes a top surface 114 and a bottom surface 116. In one embodiment, the mortar buffer is configured as multiple bevel surfaces. In other embodiments, the mortar buffer can be configured with varying geometric shapes. The top mortar buffer surface 103 connects the front surface 108 to the top surface 114. The bottom mortar buffer surface 102 connects the front surface 108 with the bottom surface 116. Similarly, the first side mortar buffer surface 105 connects the front surface 108 to the first side surface 104 and the second side mortar buffer surface 107 connects the front surface 108 to the second side surface 106. The mortar buffer connects the front surface 108 to these aforementioned surfaces along a substantially constant angle of inclination (i.e., a constant angle with respect to a chosen surface, such as the top surface 114, and the front surface 108). Although shown substantially rectangular in shape, the ACMU 100 can be embodied in other shapes and a variety of sizes for one or more of the aforementioned surfaces.

The mortar buffer preferably includes beveled surfaces, and in application, provides a buffer area for the potential residual deposit of mortar between a surface, for example the front surface 108, of the ACMU 100, and the mortar joint (e.g., the mortar that is sandwiched between adjacent ACMUs). The mortar buffer surfaces are configured to enable masonry tools deeper ingress into a mortar joint. The mason tools primarily "travel" on the surfaces of the mortar buffer instead of the ACMU edges, the latter which often presents more discontinuities (especially with rough or rock face surfaces) to the mason tool that the mason attempts to overcome in his or her efforts to remove excess mortar or strike straight mortar joints. Thus, the mortar buffer can reduce mortar smears on exposed surfaces and enable the formation of substantially straight joint lines that accentuate the parallel edges of adjacent ACMUs 100.

FIG. 2 is a front perspective view of an example split-face ACMU 200 with a mortar buffer that surrounds a front surface 208, in accordance with one embodiment of the invention. Similar features to those shown in FIG. 1, including items 202, 203, 204, 205, 206, 207, 210, 212, 214, and 216 will not be discussed further. As shown, the front surface 208 of the split-face ACMU 200 has a rock-like, or rough surface preferably created from splitting two ACMUs joined together along a fracture or split line, as described below. As would be understood by those having ordinary skill in the art, the split-face ACMU 200 can be embodied in varying sizes and shapes, with the rough surface on more than one or different sides of the ACMU 200 in other embodiments.

Note that the reference to smooth and rough surfaces will be understood in the context that a smooth surface, when viewed on a macroscopic level (e.g., viewed at a distance of approximately 5 feet), is characterized as having a predominantly continuous and relatively even surface. For example, in some embodiments, an average peak-to-valley surface measurement of less than or equal to 1/32 inch can be used to characterize a surface as a smooth surface, with 1/64 or 1/128 being additional thresholds below or equal to which can be used to characterize additional degrees of smoothness. A molded surface of a standard basement concrete block is one example of a smooth surface, among others.

In further embodiments, a smooth surface can be further exemplified in having a reflective, shiny, and/or almost mirrored surface, similar to some polished marble or granite surfaces. An example ground surface can be characterized by an average peak-to-valley surface measurement of approximately 0.002 inch, and an example polished surface can be characterized by an average peak-to-valley measurement of approximately 0.0007 inch. A rough surface, also viewed from a macroscopic perspective, is a surface that can be characterized as having predominantly uneven surfaces, ridges, and/or projections on the surface. For example, in some embodiments, threshold peak-to-valley measurements above those described for the smooth surfaces can be used to characterize a surface as being a rough surface. Hybrids of the two surfaces (e.g., a polished surface with valleys) can be characterized in some embodiments depending on the feature that predominates the surface. For example, a polished, mirror-like front surface that comprises the majority of the front surface area in the plane of the front surface can be characterized as a smooth surface, despite the existence of interspersed valleys.

Another characteristic of the surface appearance can be the glossiness (e.g., how shiny the surface appears). Well-known standards, such as American National Standard B46.1, can be used for guidance, among others. For example, using a laser profilometer having a resolution of 1 micron, and measuring along a defined length (e.g., 50 mm substantially straight line path) along a representative surface, and further using filters (e.g., setting a cutoff frequency to be at 8 mm with a $1^{st}$ order roll-off) to remove detected signals corresponding to large peak-to-valley deviations (e.g., sometimes referred to in industries as removing the "waviness" feature of a sampled surface), the arithmetic average roughness, Ra, can be determined. As is known, Ra is the arithmetic mean of departure of a roughness profile from a mean line. In other words, Ra provides an indication of "roughness" or the texture of the surface on a small-scale perspective. The values of Ra also have traditionally been used as a measure of "glossiness" for the surface. Ra can be represented as follows:

$$Ra=1/L|y|dx \quad \text{(Eq. 1)}$$

where "L" is the assessment length, and the integral is evaluated from x=zero to L. In some implementations, Ra values of approximately 26 microns or less can be used to characterize a surface as shiny or reflective. The lower the value of Ra, the more shiny or reflective the appearance.

Figure 3A:
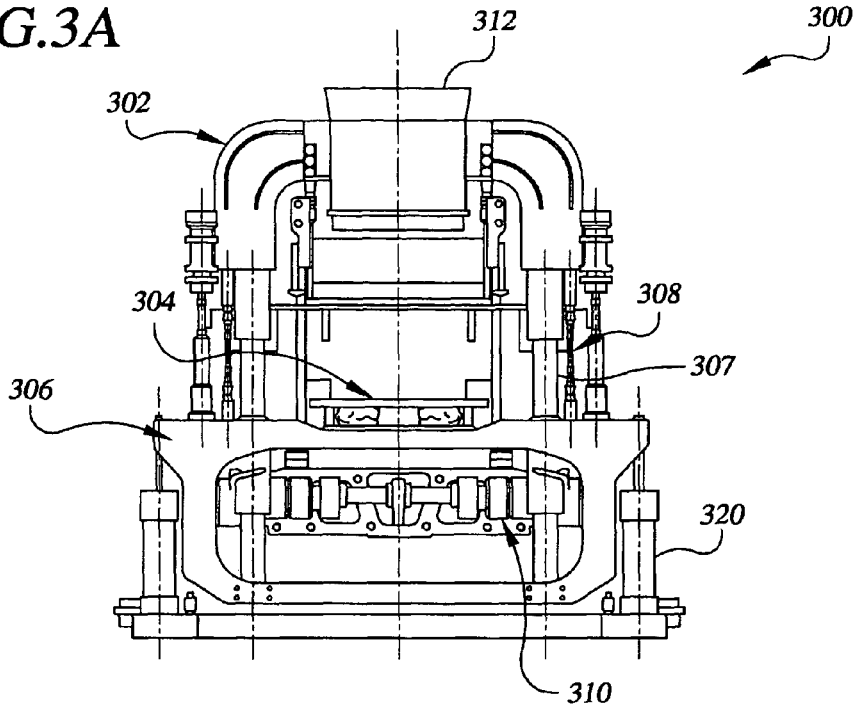
FIG. 3A is a front elevation view of an example block machine assembly for manufacturing ACMUs with a mortar buffer around the front surface, in accordance with one embodiment of the invention.
Figure 3B:
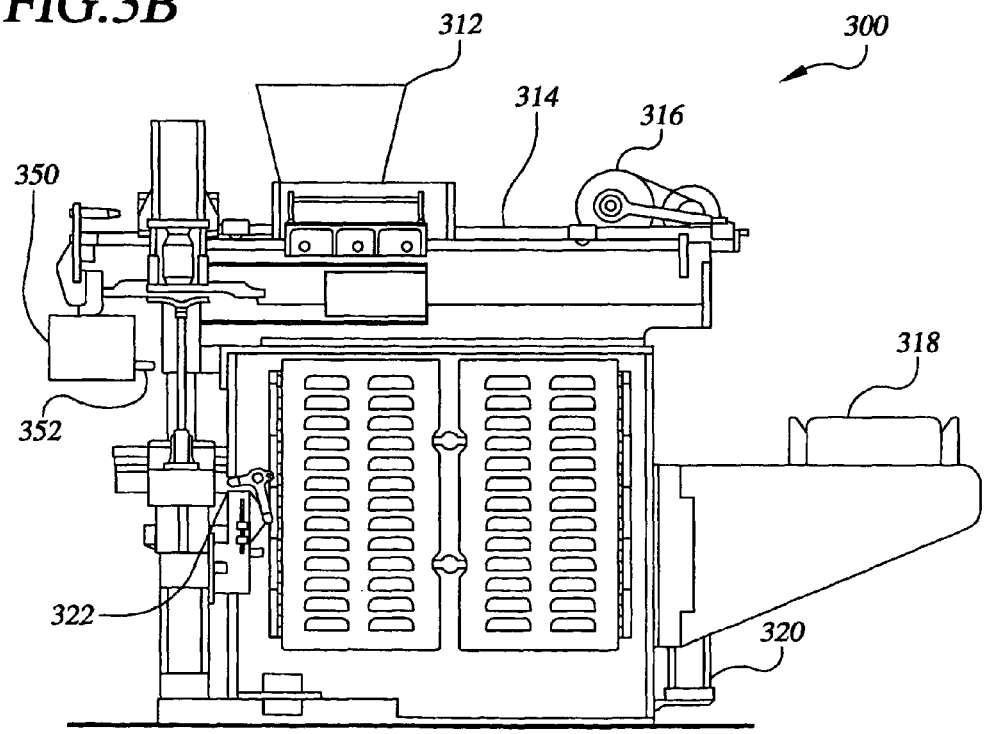
FIG. 3B is a side elevation view of the example block machine assembly for manufacturing ACMUs with a mortar buffer around the front surface, in accordance with one embodiment of the invention.

FIGS. 3A-3B illustrate an example block machine assembly 300 used in the implementation of the ACMU manufacturing methods, in accordance with one embodiment of the invention. The example block machine assembly 300 generally receives a zero slump mix, and through a series of steps that includes vibration and compression, produces blocks (e.g., ACMUs). Three primary functions of the block machine assembly 300 include, in general, pallet supply, ACMU mix supply, and ACMU forming and/or transfer, implemented through hydraulic, pneumatic, mechanical, and/or electrical control. In other embodiments, the aforementioned functions can be carried out in modules that are separate from the block machine assembly 300. With reference to FIGS. 3A and 3B, the example block machine assembly 300 includes a compression beam 302, a pallet table 304, a main beam 306, a height stop 308, a vibrator 310, and a hopper 312. Also included is a core puller 350 (that includes one or more reciprocating filler plugs 352), a feed drawer 314, an agitator 316, a pallet hopper 318, a riser cylinder 320, and a flow control mechanism 322. Note that the filler plugs 352 are also known as core forming bars.

During the ACMU forming cycle, the feed drawer 314 supplies a defined amount of zero slump mix to the block machine assembly 300. Preferably, the mix includes particulate matter that is less than ⅜ inch in overall size, although greater particulate sizes can be used in other embodiments. The mix is distributed to the feed drawer 314 through the hopper 312. When the feed drawer 314 is full, it moves forward (to the left in FIG. 3B), thus closing off further mix from the hopper 312. Forward movement of the feed drawer 314, assisted by vibration, allows mix to fall into the mold. The agitator 316, in cooperation with a agitator grid (not shown), agitates the mix as it is deposited into the mold. Consistent ACMU density is achieved by feed drawer dwell timing, which is automatically established by the block machine control system (not shown) in relation to an electronic height stop contact (not shown) of the height stop 308 and compression time required.

Formation of the ACMU, such as the example ACMU 100 (FIG. 1), is accomplished by using compression beam and main beam structures that work with a mold and a mold vibrator 310. The final ACMU is determined by the height configuration of the block machine assembly 300 and the type of mold in use. The main beam 306 is hydraulically operated on guide columns 307. The main beam 306 houses a pallet table 304 and adjustable height stop contact bolts (not shown) in the height stop 308. The main beam 306 operates through stripper cylinders 320 and rotary flow control valves 322. The rotary flow control valves 322 regulate the stripper downstroke speed for smooth stripping of ACMUs.

The pallet table 304 is located directly below the mold to provide a stable base as ACMUs are being formed. During compression, high-pressure air via connecting hoses is directed to air actuators located between the table sections to help ensure uniform density and ACMU quality. The block machine assembly 300 is available in different models depending in part on the pallet size accepted by the pallet table 304. Representative standard size pallets accommodated include 19½×26" or (29" or 37"), 21⅝×26" (or 29"), as well as non-standard sizes. In other embodiments, the pallet table 304 can be adjusted to accommodate the various sizes in one model. The pallet hopper 318 is part of a "circular" feed system for maintaining a continuous supply of pallets. The core puller 350 works in cooperation with other components of the block machine assembly 300 and the mold structures to provide a lower mortar buffer surface of the mortar buffer, as explained below. Although shown as a separate module of the block machine assembly 300 (e.g., secured to structures of the block machine assembly 300), the core puller 350 can be integrated into the block machine assembly 300 in other embodiments.

Figure 4A:
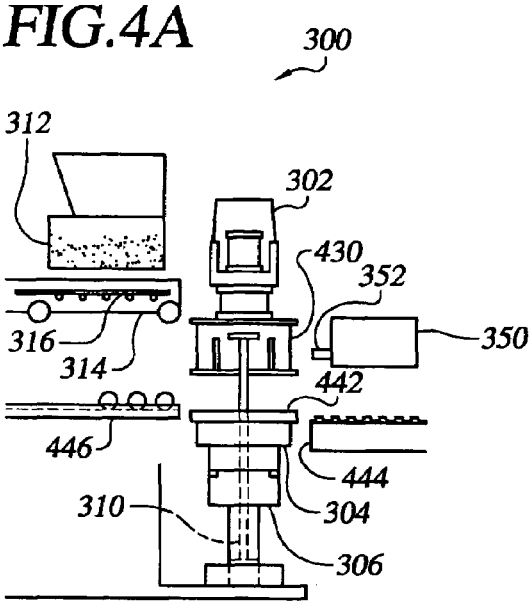
FIGS. 4A-4H are block diagram side elevation views illustrating representative steps in one example ACMU manufacturing method, in accordance with one embodiment of the invention.

FIGS. 4A-4H illustrate operational steps of the ACMU manufacturing methods, in accordance with one embodiment of the invention. FIGS. 4A-4H are block diagram side elevation views of select components of the block machine assembly 300, including the core puller 350, described in association with FIGS. 3A and 3B. Referring to FIG. 4A, shown are the hopper 312, the agitator 316, the feed drawer 314, the compression beam 302, the core puller 350 that includes one or more filler plugs 352, pallet table 304, main beam 306, and vibrator 310. Further shown is a pallet hold down 446 that feeds pallets to the pallet table 304, a pallet 442, a receiving conveyor 444, and the mold 430. Before beginning an automatic cycle, the block machine assembly 300, in one embodiment, starts in a "relaxed position" or "home position". The "relaxed position" is a position wherein the compression beam 302 and shoe assembly (obscured from view by the mold 430) is down, the feed drawer 304 back, and a clean pallet 442 is on the pallet table 304.

Figure 4B:
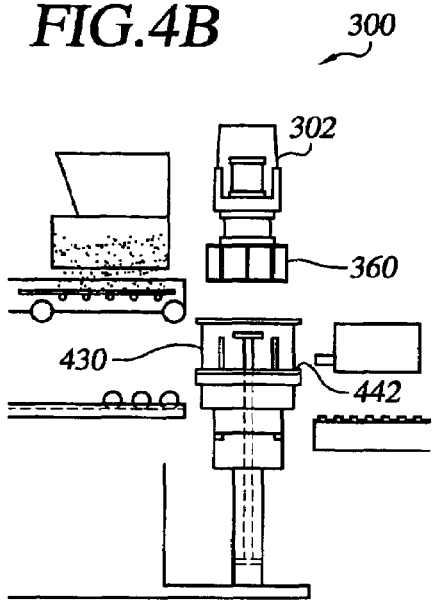
Figure 4C:
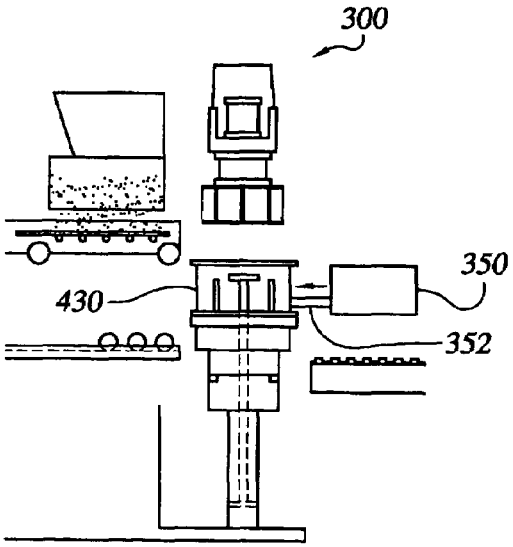
Figure 4D:
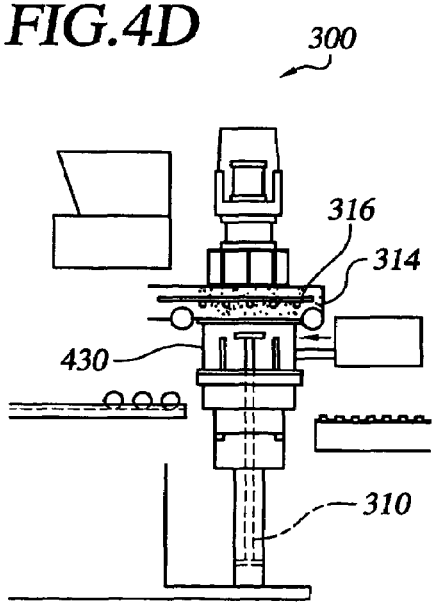
Figure 4E:
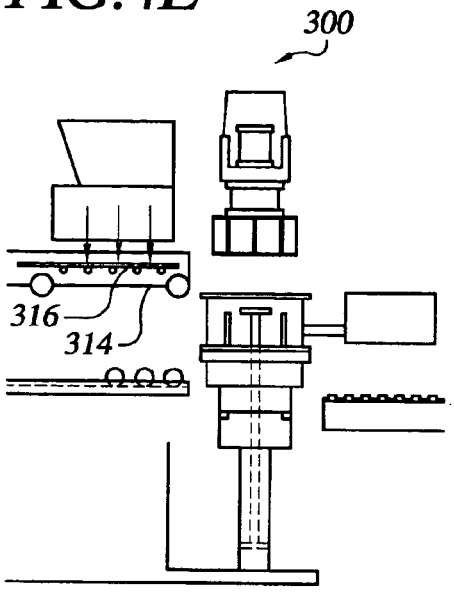

Referring to FIG. 4B, when the automatic cycle is started, the compression beam 302 and shoe assembly 360 move upward so that the pallet 442 is under the mold 430, and mix (represented by the dots in the hopper 312 and in the feed drawer 314, FIG. 4A) is dispensed from the hopper 312 to the feed drawer 314, as described above. As shown in FIG. 4C, the core puller 350 inserts filler plugs 352 into openings of the mold 430, the filler plugs 352 then extending to the opposing side openings in the mold 430. Note that in other embodiments, the opposing side of the mold 430 does not have openings, and thus the filler plugs 352, when inserted into the mold 430, extend until flush with the interior opposing side of the mold 430 (i.e., opposing the side having the opening for the filler plugs 352), or other internal structures of the mold 430. With reference to FIG. 4D, the feed drawer 314 then comes forward, transporting the mix to the mold 430, and the agitator 316 is activated. The vibrator 310 comes on at a predetermined time and continues for a specific length of time. When the feed drawer dwell timing and selected oscillation are complete, the feed drawer 314 moves back and the agitator 316 is deactivated, as shown in FIG. 4E.

Figure 4F:
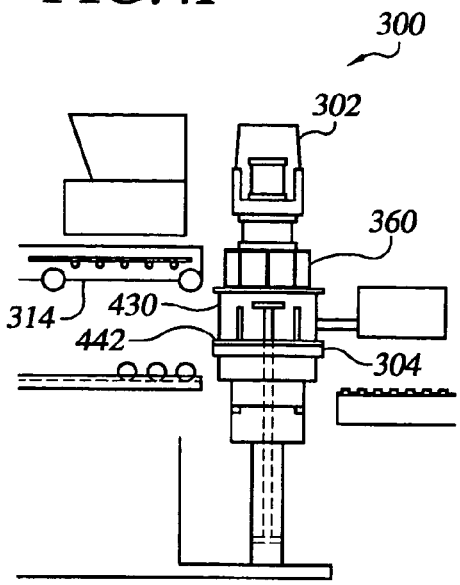
Figure 4G:
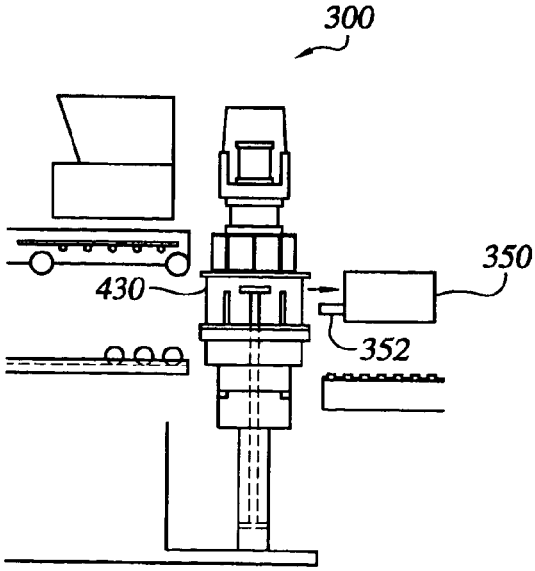
Figure 4H:
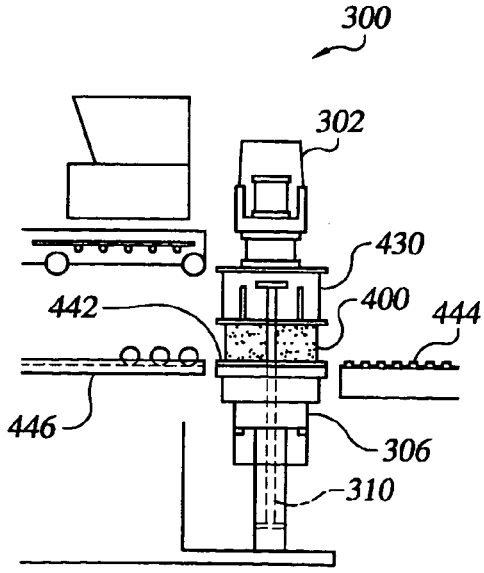

As shown in FIG. 4F, once the feed drawer 314 is back, the compression beam 302 comes down, which pushes down the shoe assembly 360. At this point, high pressure is applied to the pallet table 304 so that the pallet 442 is forced up against the mold 430. After approximately 1-2 seconds, as determined by mix composition, height stop contact, automatic controls, and/or release time settings, the filler plugs 352 retract from the mold 430 (FIG. 4G) and return back into the core puller 350, and then both the main beam 306 and the compression beam 302 move downward to strip the ACMU 400 with the peripheral mortar buffer from the mold 430, and the pallet table air pressure is switched to low (FIG. 4H). The vibrator 310, which in one embodiment is operated through timer circuitry (not shown), is preferably stopped when the ACMU 400 is approximately half-way out of the mold 430. When clear of the mold 430, the pallet 442 and ACMU 400 are pushed onto a receiving conveyor 444 (or other take away device in other embodiments) preferably by automatic operation of the pallet feed system, and the next pallet is fed by the pallet hold down 446.

Figure 5A:
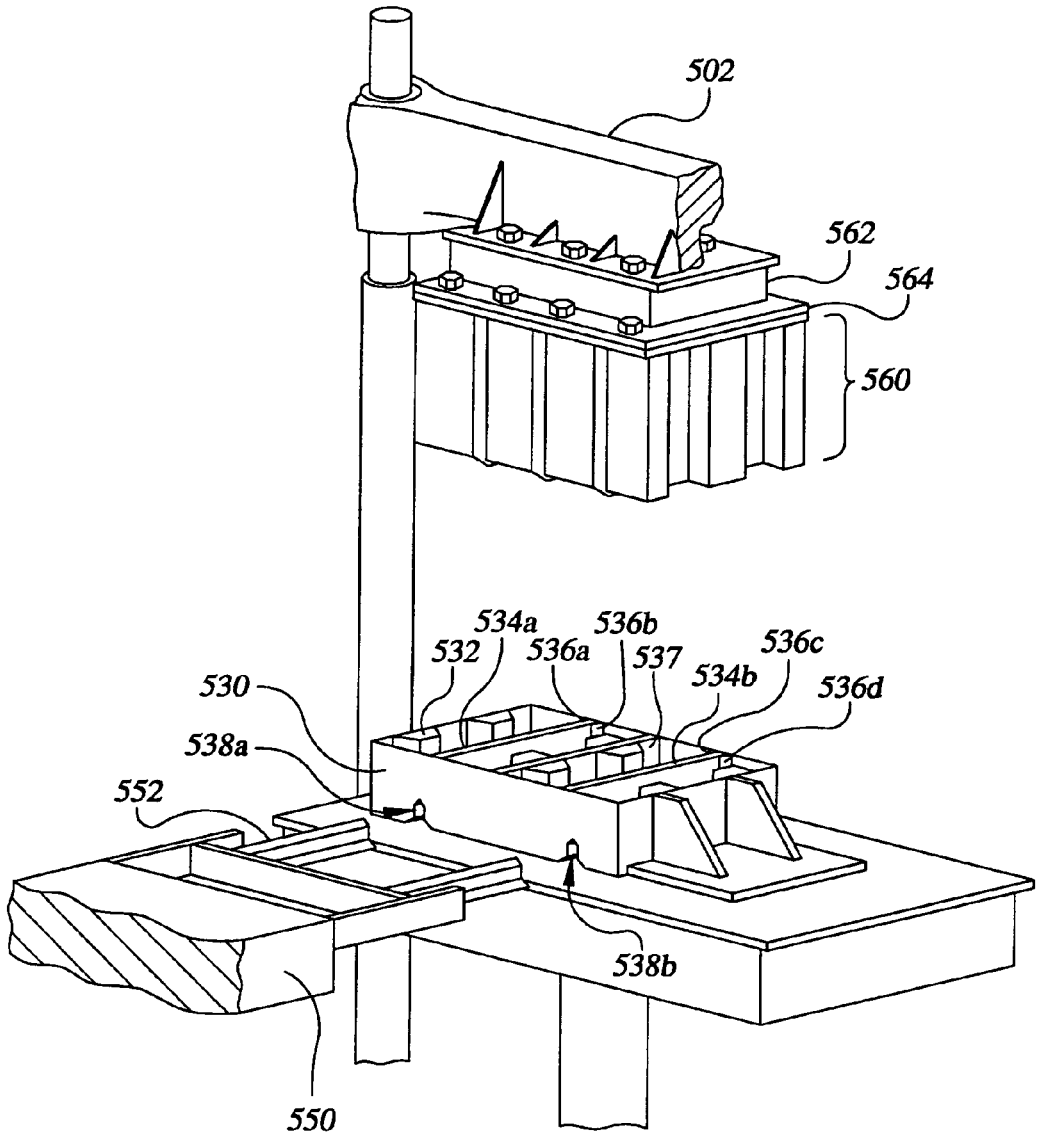
FIG. 5A is a front perspective view of select components similar to those used in the example ACMU manufacturing method illustrated in FIGS. 4A-4H, in accordance with one embodiment of the invention.

FIG. 5A is a front perspective view of select components similar to those used in the example ACMU manufacturing method illustrated in FIGS. 4A-4H, in accordance with one embodiment of the invention. Generally, a shoe assembly 560, mold 530, and core puller 550 cooperate to form mortar buffer surfaces around the periphery of surfaces of multiple ACMUs, preferably around the front faces, although not limited to the periphery of this surface or one surface. The shoe assembly 560 is attached to a head plate 564, which is attached to the compression beam 502 through a head spacer 562. The shoe assembly 560 is shown as a molded assembly of a shape and/or configuration of uniform external design throughout (e.g., the structure throughout the assembly 560 is mirrored from the bottom-up). In some embodiments, the desired shape of the top of an ACMU can be formed by a like-configured bottom surface of a shoe assembly, with the rest of the shoe assembly providing only enough structural support to attach the bottom surface to a head plate 564 (e.g., without maintaining uniformity in shape and/or configuration throughout the shoe assembly, such as to reduce weight, among other reasons), or solid or hollow in other embodiments.

The shoe assembly 560 is shaped to fit snugly (e.g., tolerance of approximately 1/16th inch between the shoe assembly 560 and an interior surface of the mold 530) within the interior of the mold 530, enabling the shoe assembly 560 to be lowered through the mold 530 during the block stripping operation, as described above. The shoe assembly 560 is also configured to provide a mortar buffer (e.g., bevel) between a top surface and a front surface of a formed ACMU, as is described below. The mold 530, shown resting on a pallet 542, includes core bars 532 that in one embodiment can be secured to the internal structures of the mold 530, integrally formed to internal structures of the mold 530 (e.g., the partition plate), or in other embodiments, can be detachable. The core bars 532 can be of practically any geometric configuration which is desired in the formed ACMU, and preferably has rounded edges for ease in removal of the formed ACMU from the mold 530. The mold 530 also includes partial partition plates (or divider plates) 534*a*, 534*b* and full partition plates 537. The partial partition plates 534*a*, 534*b* are secured to gussets 536*a-d* (for one side of the mold 530, with the understanding that symmetrically positioned gussets (not shown) are used to secure the partition plates 534*a*, 534*b* for the opposing side of the mold 530), and are positioned where the peripheral mortar buffer is to be formed. The full partition plates 537 provide a separation for individual units. The gussets 536*a-d* are preferably used to form a mortar buffer surface running along the sides between the front surface of an ACMU and the side surfaces of the ACMU. In other embodiments, the partial partition plates 534*a*, 534*b* and gussets 536*a-d* can be formed as one integral piece (e.g., a machined partition plate). The mold 530 further includes filler plug slots 538*a*, 538*b* that receive filler plugs 552 from a core puller 550 during a molding operation.

Figure 5B:
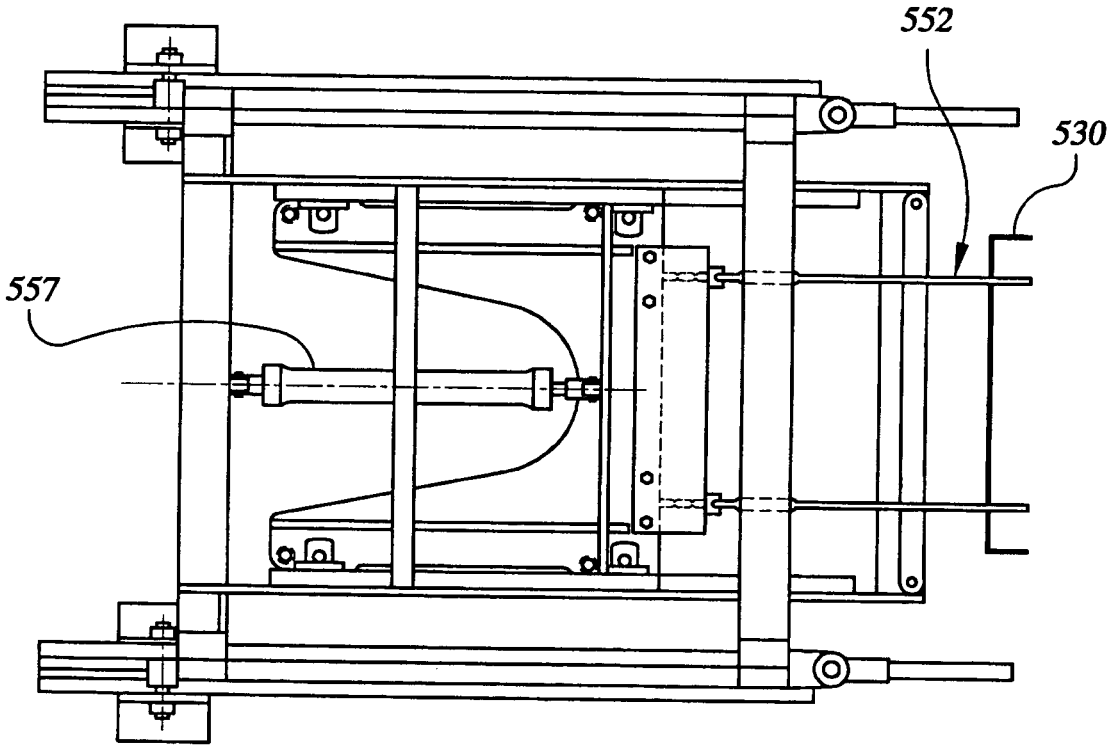
FIG. 5B is a top plan view of a core puller that shows select internal components, in accordance with one embodiment of the invention.

Referring to FIG. 5B, the core puller 550 is shown with the box "opened" to viewing, and shows a hydraulic cylinder 557 that provides the reciprocating motion for the filler plugs 552 which enter and exit the mold 530. Although the core puller 550 is preferably actuated with hydraulic cylinders, in other embodiments the core puller can be actuated, pneumatically, electrically, and/or mechanically according to well-known mechanisms to enable reciprocating motion of the filler plugs 552.

Figure 6A:
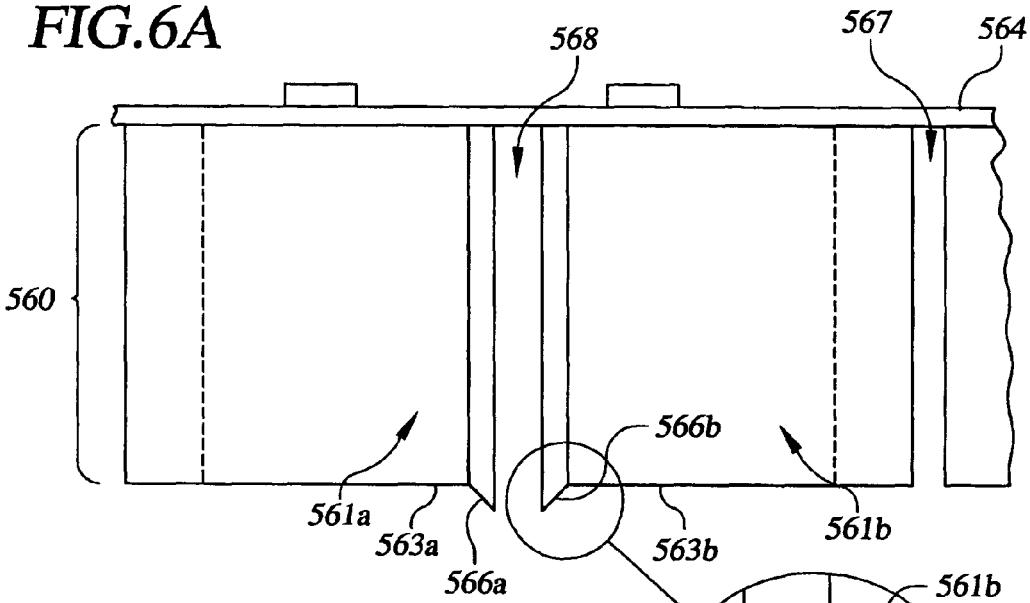
FIG. 6A is a partial side elevation view of the example shoe assembly shown in FIG. 5A, in accordance with one embodiment of the invention.

FIGS. 6A-6D provide illustrations of several views of the shoe assembly 560. FIG. 6A is a partial side elevation view of the example shoe assembly 560 shown in FIG. 5A, in accordance with one embodiment of the invention. The shoe assembly 560 is attached to the head plate 564, in one embodiment, by bolts, although other mechanisms for securing the shoe assembly 560 to the head plate 564 are contemplated (e.g., welding, riveting, etc.). As shown, the shoe assembly 560 is divided into ACMU contact areas 561*a*, 561*b* by partition slots 568 and 567. The partition slot 568 is configured to enable the shoe assembly 560 to conformably fit over the partial partition plate 534*a* (FIG. 5A) of the mold 530 (FIG. 5A) and the gussets 536*a,b* (FIG. 5A), whereas the partition slots 567 are configured to enable the shoe assembly 560 to conformably fit over the full partition plate 537 (FIG. 5A) of the mold 530. The contact areas 561*a*, 561*b* are symmetrical, with the contact area 561*a* having features that are used to form a top mortar buffer surface for one ACMU, and the contact area 561*b* having features that are used to form a top mortar buffer surface for an adjacently formed ACMU. Since contact areas 561*a* and 561*b* are symmetrical, further discussion is directed to the features of contact area 561*b*, with the understanding of similar application to contact area 561*a*. Contact area 561*b* includes a bottom surface comprising a first bottom surface 563*b* and a top mortar buffer surface forming area 566*b*, which is configured to form a top mortar buffer surface of an ACMU. Areas of the mold 530 (FIG. 5A) that include mix will be in contact with the first bottom surface 563*b* and the top mortar buffer surface forming area 566*b* of this contact area 561*b* of the shoe assembly 560 (and similarly in contact with bottom surfaces 563*a* and 566*a* of 561*a*) during, for example, the compression stage of the molding operation.

Figure 6B:
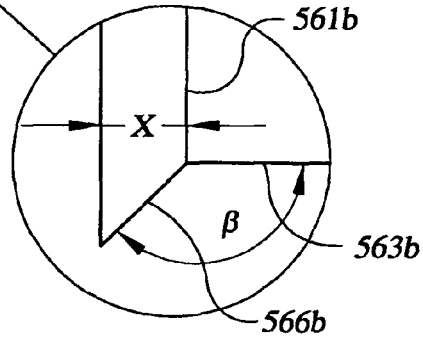
FIG. 6B is a close-up side elevation view of a top mortar buffer surface forming area of the example shoe assembly of FIG. 6A, in accordance with one embodiment of the invention.

A more detailed view of the top mortar buffer surface forming area 566*b* is shown in FIG. 6B. The top mortar buffer surface forming area 566*b* is preferably configured as a beveled extension of the contact area 561*b*, and thus extends downward from the first bottom surface 563*b* of the contact areas 561*b* of the shoe assembly 560 (FIG. 6A) along a substantially constant angle of inclination, β. The top mortar buffer surface forming area 566*b* forms an angle, β, with the bottom surface 563*b* that results in the formation of a thirty-degree, relatively constant angle of inclination between the top surface of an ACMU and the front surface of the ACMU. That is, β is preferably approximately 150 degrees. Note, however, that other embodiments can use a different angle, β, for example anywhere between 120-170 degrees, to fashion the desired angle of inclination for the top surfaces of the mortar buffer of the ACMU, and thus different angles of inclination β are contemplated to be within the scope of the preferred embodiments of the invention. In other words, β can take on other angles that result in angles of inclination of 10-60 degrees between the top surface of an ACMU and the front surface of the ACMU. Further, the top mortar buffer surface forming area 566*b* preferably has a width "X" of 7/32 inch, although it can be of different dimensions in other embodiments, ranging from 1/16 inch-1/2 inch, or more, depending on the desired aesthetics, the color, shape, and size of the ACMU to be formed, the surface smoothness or roughness of the front surface of the ACMU, and/or the specified width of the mortar joint, among other factors. As indicated above, similar angles and widths apply to like-features of the mirrored contact area 561*a*.

Figure 6D:
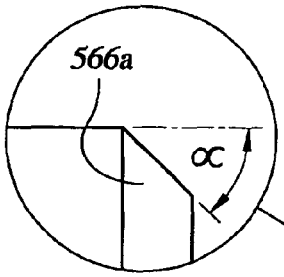
FIG. 6D is a close-up bottom plan view of the top mortar buffer surface forming area shown in FIG. 6C, in accordance with one embodiment of the invention.
Figure 6C:
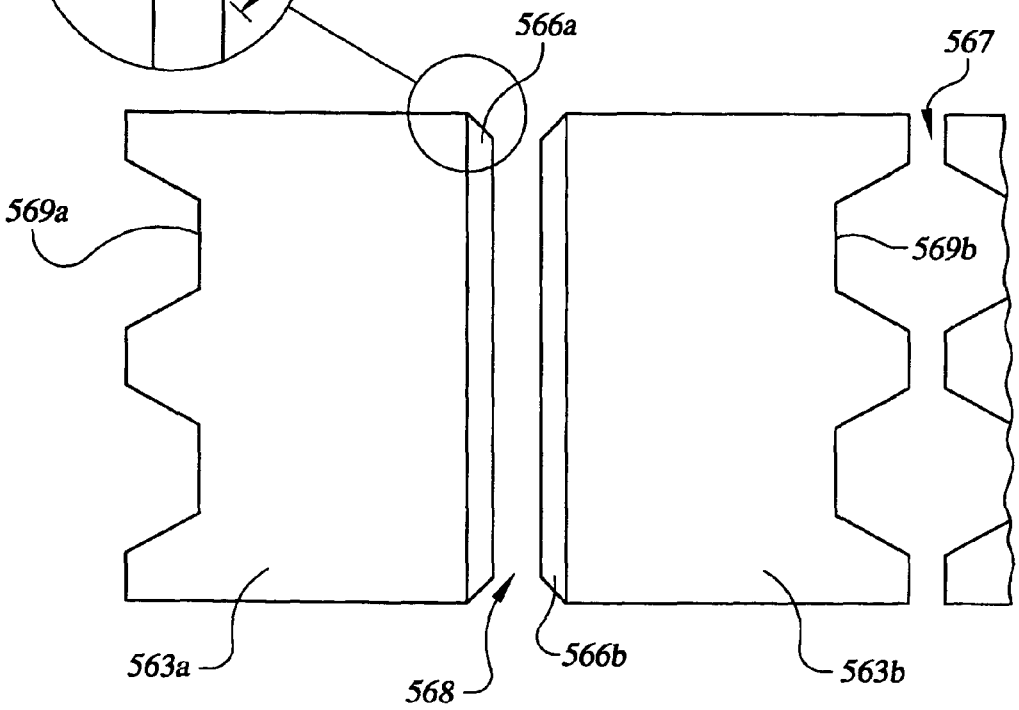
FIG. 6C is a partial bottom plan view of the example shoe assembly of FIG. 6A, in accordance with one embodiment of the invention.

FIG. 6C is a partial bottom plan view of the example shoe assembly 560 of FIG. 6A, in accordance with one embodiment of the invention. The shoe assembly 560 includes core areas 569*a*, 569*b* that are configured to conformably fit against core bars 532 (FIG. 5A) located in the mold 530 (FIG. 5A) such that when the shoe assembly 560 is lowered through the mold 530, the core areas 569*a*, 569*b* "ride" along the core bars 532. The top mortar buffer surface forming area 566*b* (or 566*a*) is also angled to conform to (mate up against) the gussets 536*b* (536*a*) (FIG. 5A) of the mold 530, such that a conforming "travel" along the gussets 536*b* is enabled during, for example, the stripping operation described above, to maintain the desired ACMU shape and mortar buffer surfaces. FIG. 6D provides a more detailed view of this angle, y, for the top mortar buffer surface forming area 566*a*, which preferably gives rise to an ACMU corner angle of 30 degrees, with a possible range of 10-60 degrees for other embodiments.

Figure 7A:
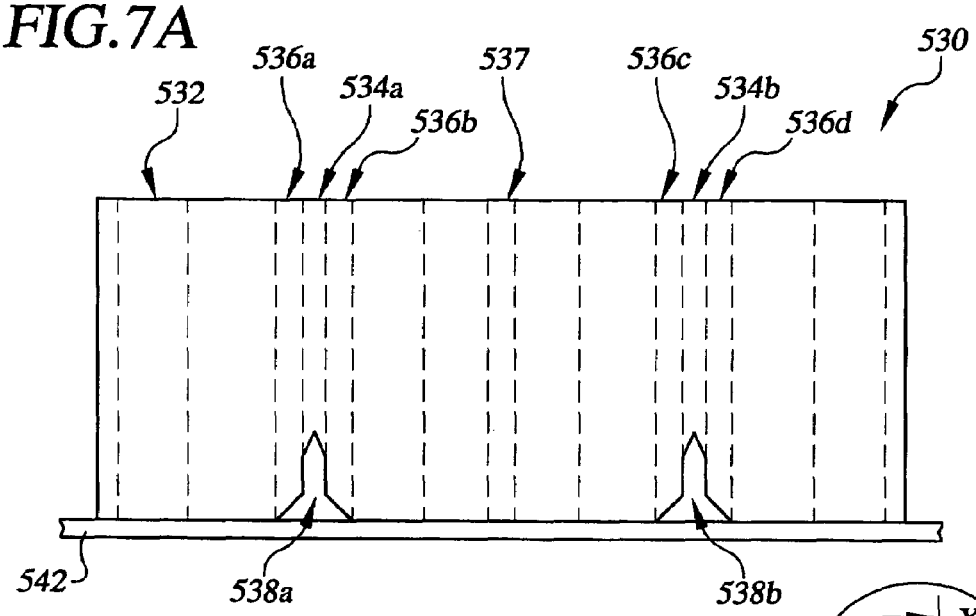
FIG. 7A is a front elevation view of the example mold shown in FIG. 5A, in accordance with one embodiment of the invention.
Figure 7C:
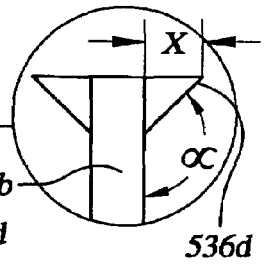
FIG. 7C is a close-up top plan view of a side mortar buffer surface forming area shown in FIG. 7B, in accordance with one embodiment of the invention.
Figure 7B:
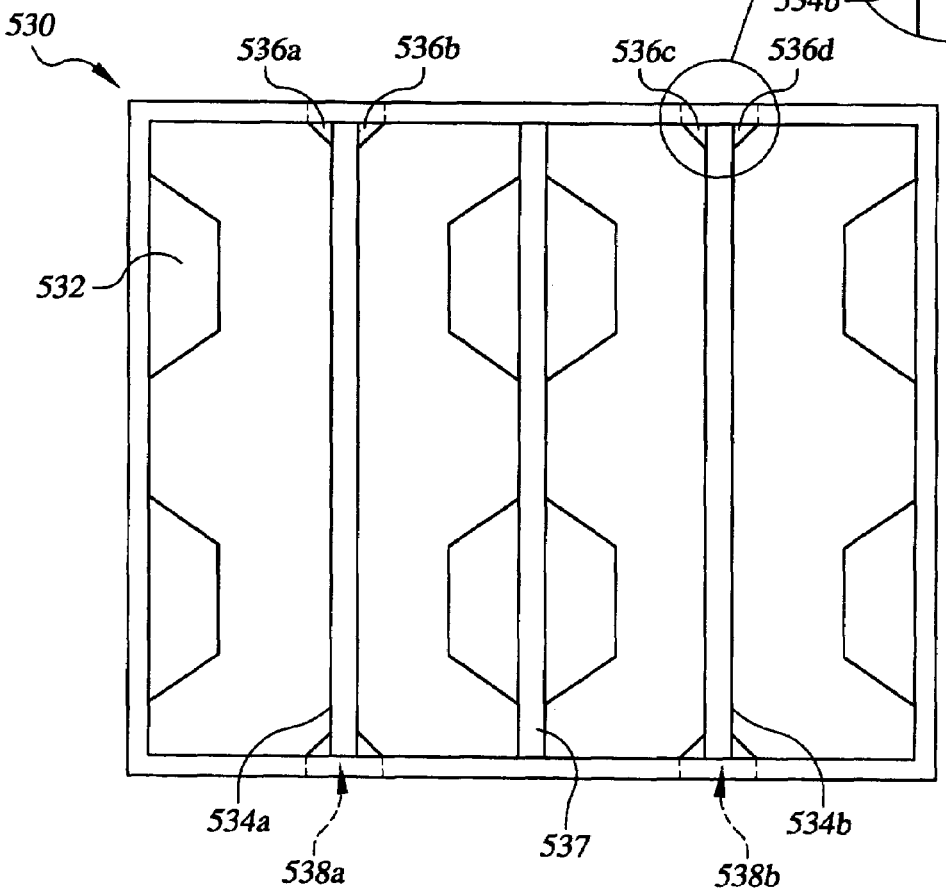
FIG. 7B is a top plan view of the example mold of FIG. 7A, in accordance with one embodiment of the invention.

FIGS. 7A-7C illustrate select features of the mold 530 of FIG. 5A. FIG. 7A is a front elevation view of the example mold 530, in accordance with one embodiment of the invention. As shown, the mold 530, resting on the pallet 542, includes filler plug slots 538*a*, 538*b* that will receive filler plugs 552 (FIG. 5A) that are used to form the bottom mortar buffer surface of a mortar buffer for an ACMU. The dashed lines running from the pallet 542 to the top of the mold 530 represent the "hidden" core bars 532 (i.e., hidden or obscured from the side view), the gussets 536*a-d* (including symmetrically-placed opposing side gussets), the partial partition plate 534*a*, 534*b*, and the full partition plate 537. FIG. 7B provides a top plan view of the mold 530 that further illustrates some select features of the mold 530. The mold 530 includes core bars 532, partial partition plates 534*a*, 534*b*, full partition plate 537, and gussets 536*a-d*. The filler plug slots 538*a*, 538*b* are represented by the dashed lines extending to each partition plate 534*a*, 534*b* that includes a gusset 536*a-d*, which reflects the fact that the filler plugs 552 in operation preferably extend from one side of the mold 530 to the opposing side and beyond. As indicated above, in other embodiments, the filler plug slots 538*a*, 538*b* may be located in one side of the mold box 530 such that the opposing side has no filler plug slots (e.g., the filler plugs 552 terminate flush against the interior side of the mold 530 on the opposing side or the filler plugs 552 abut against the surface of a gusset 536*a-d* located at the opposing side). A closer detail of the gusset 536 is shown in FIG. 7C, which illustrates that the gusset 536*d* (and other gussets), for example, forms an angle, α, with the partition plate 534*b* preferably of approximately 150 degrees, which results in an angle of inclination for the formed ACMU of preferably 30 degrees between the angled surface of a side mortar buffer surface of the ACMU (e.g., second side mortar buffer surface 105 (FIG. 1)) and the side surface of the ACMU (e.g., second side surface 106 (FIG. 1)). Note that other angles of inclination are contemplated within the scope of the preferred embodiments, including a range of 120-170 degrees, as indicated above. Further, the width "X" of the gusset 536*d* (and other gussets) is preferably approximately 7/32 inches, although a range of 1/16 inch-½ inch, or more, is contemplated for other embodiments, as previously discussed.

Figure 8:
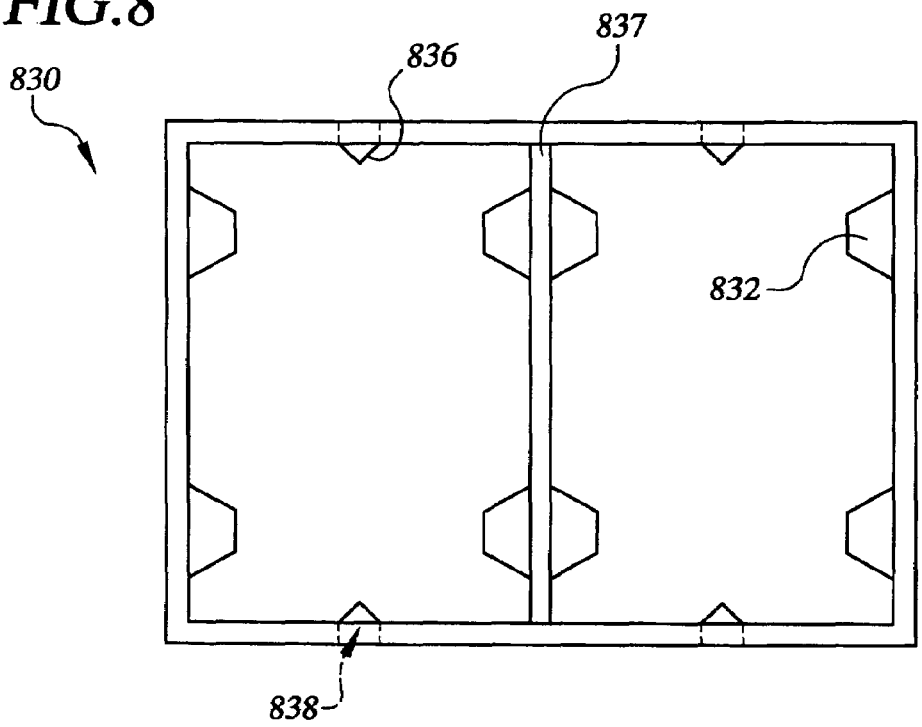
FIG. 8 is a second example mold for forming a split-piece ACMU such as the split-piece ACMU of FIG. 2, in accordance with one embodiment of the invention.
Figure 9:
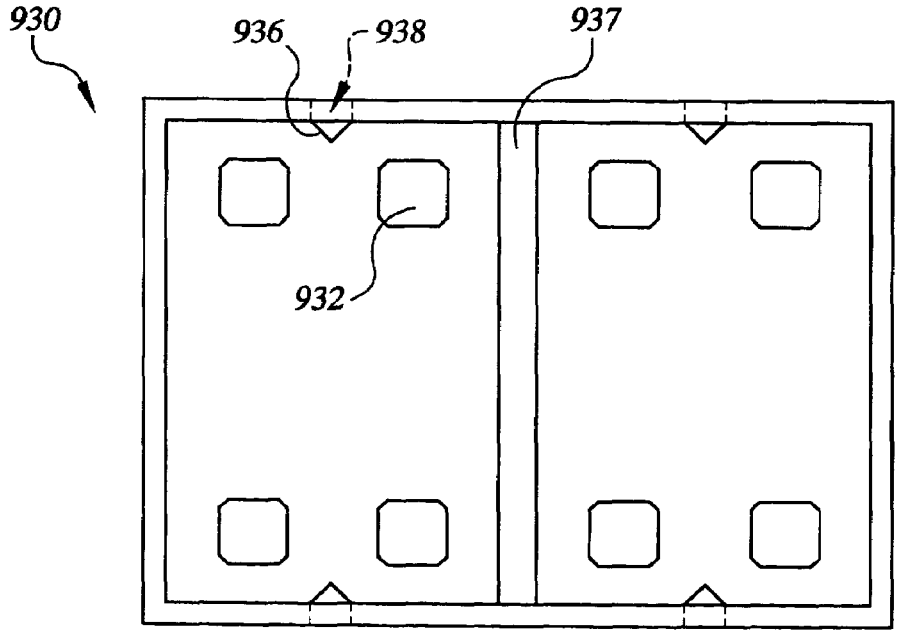
FIG. 9 is a third example mold for forming a split-piece ACMU with core areas located centrally in the ACMU, in accordance with one embodiment of the invention.

Note that the mold 530 is shown as having the capability of forming four (4), smooth front surface ACMUs similar to those shown in FIG. 1. Other quantities of units, of various shapes and sizes and core configurations are within the scope of the preferred embodiments of the invention. For example, FIG. 8 shows a mold 830 that is configured to form split-face units, similar to that shown in FIG. 2. The mold 830 includes gussets 836, that in cooperation with a conforming shoe assembly and filler plugs that enter at filler plug slots 838 in accordance with the preferred embodiments of the invention provides a peripheral bevel (e.g., a mortar buffer) for each of two adjoining ACMUs. The area joining the bevels of each unit acts as a fracture point that closes the distance between opposing sides of the ACMU, facilitating the splitting of the adjoining units. Note that the full partition plate 837 serves to separate ACMU pairs. Although two pairs of ACMUs are shown, other quantities can be formed in other embodiments. Further, the core bars 832 are positioned to form "W" back configurations as shown in FIGS. 1 and 2, although other back configurations are contemplated to be within the scope of the preferred embodiments of the invention, such as a flat back surface configuration, among others. For example, FIG. 9 illustrates a mold 930 for forming split-face ACMUs with core areas formed in the center of the ACMU, resulting in flat back surfaces. Thus, the core bars 932 are located centrally to each ACMU, though not necessarily limited to this configuration for other embodiments. Similar to the mold 830 shown in FIG. 8, the mold 930 includes gussets 936 that form side bevels of a formed mortar buffer that can serve as fracture points for each ACMU pair, as well as filler plug slots 938 and a partition plate 937. Note that smooth face ACMUs can also be formed using this mold 930, for example modified with the addition of a partition plate extending between the gussets 936.

Figure 10A:
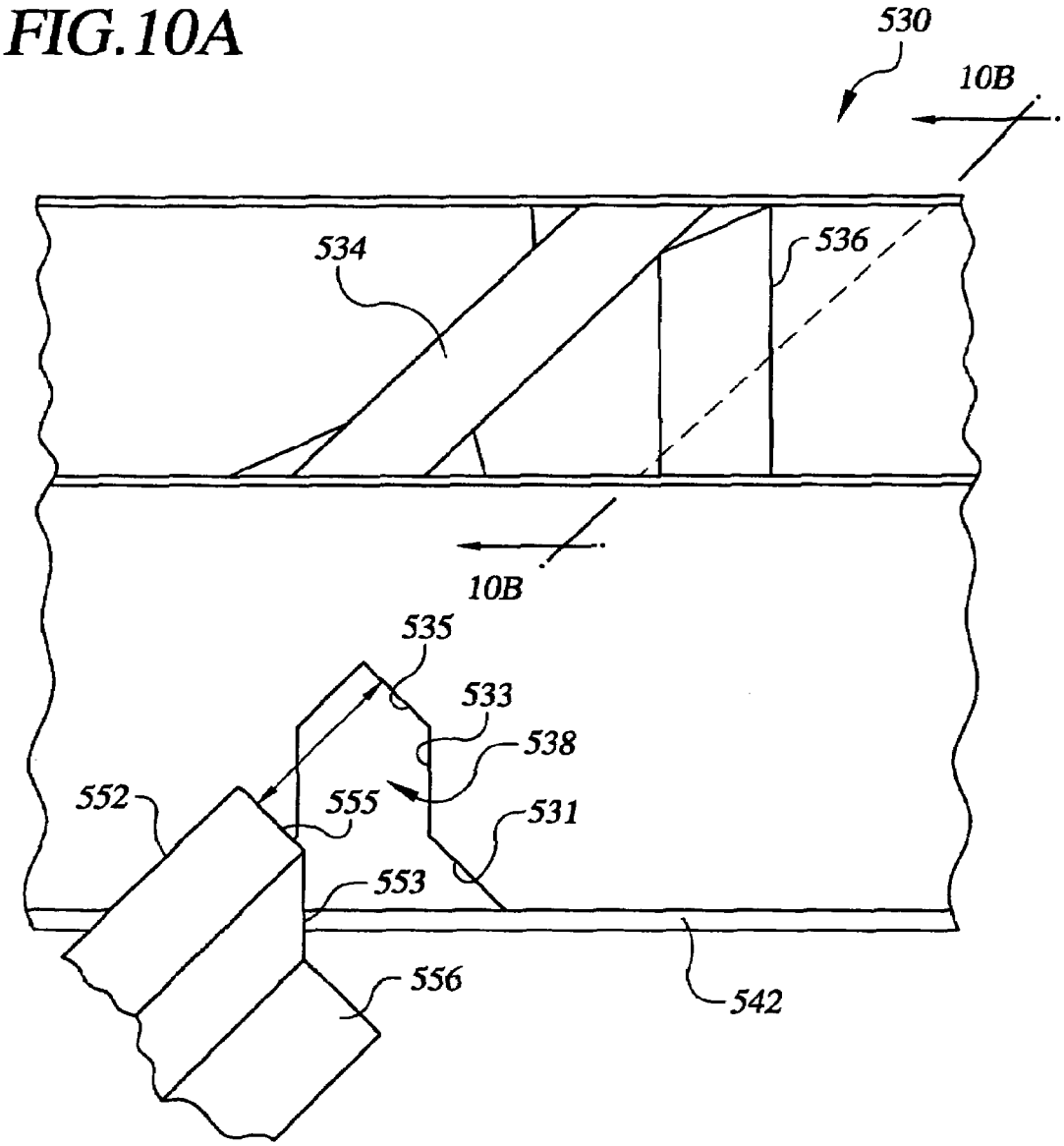
FIG. 10A is a front perspective view of an example divider plate, side mortar buffer surface forming area, and filler plug, some of which are shown in FIG. 7B, in accordance with one embodiment of the invention.

FIG. 10A is a front perspective view of the partition plate, side mortar buffer surface forming area, and filler plug as partially shown in FIG. 7B, in accordance with one embodiment of the invention. This perspective view further illustrates some of the select components of the mold 530 and filler plug 552 responsible for forming the side and bottom mortar buffer surfaces of an ACMU. The gussets 536 are used to form the mortar buffer surface of the sides of an ACMU, and are secured, in one embodiment, to the partition plates 534 in positions where filler plugs 552 will be inserted and withdrawn. The mold 530 includes a filler plug slot 538 that provides an opening between the mold 530 and the pallet 542 for a filler plug 552 to be inserted and then withdrawn, as described above. A dual-headed arrow represents that the filler plug 552 travels in both directions during an ACMU molding operation of the preferred embodiments. As shown, the filler plug 552 has a top surface 555, a middle surface 553, and the a bottom mortar buffer surface forming area 556 that forms the bottom mortar buffer surface of an ACMU. The filler plug 552 enters and leaves the filler plug slot 538 in a manner such that the top surface 555, middle surface 553, and bottom mortar buffer surface forming area 556 travel past the top portion 535, middle portion 533, and bottom portion 531 of the side of the mold 530 within thousandths of an inch tolerance.

Figure 10B:
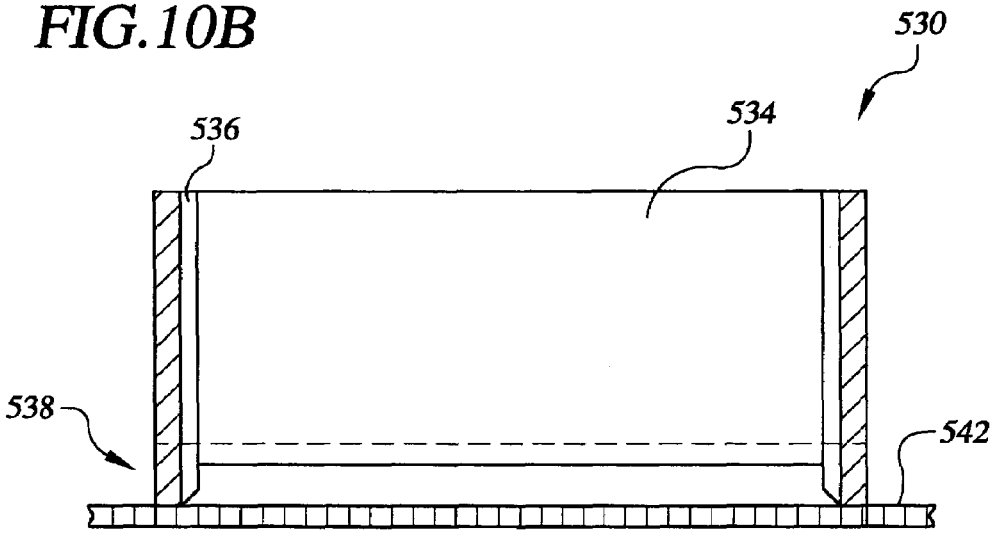
FIG. 10B is a cross-sectional side view along line 10B-10B of the mold box in FIG. 10A, in accordance with one embodiment of the invention.

FIG. 10B is a cross-sectional side view along line 10B-10B of the mold box in FIG. 10A, in accordance with one embodiment of the invention. The mold box 530 includes a filler plug slot 538 that enables a filler plug 552 (FIG. 10A) to enter between the mold 530 and the pallet 542. The partition plate 534 and attached gussets 536 are configured to enable the filler plug 552 (FIG. 10A) that enters the filler plug slot 538 to pass below the partition plate 534 and by the gussets 536 (within a tolerance of thousandths of an inch) and extend to, or beyond, the opposing side gussets 536 of the mold 530.

Figure 10C:
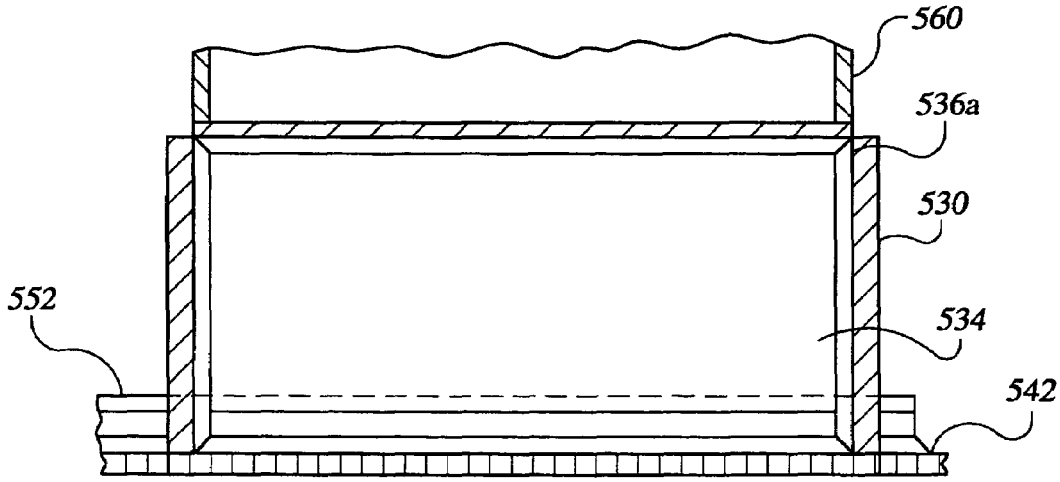
FIG. 10C is a cross-sectional side view along line 10B-10B of the mold box in cooperation with a filler plug and shoe assembly, in accordance with one embodiment of the invention.

FIG. 10C shows the mold 530 with the shoe assembly 560 joining the top surface of the mold 530, as well as the filler plug 552 sliding between the partition plate 534 and the pallet 542. The shoe assembly 560 conformably fits against the gussets, for example gussets 536*a*

Figure 11A:
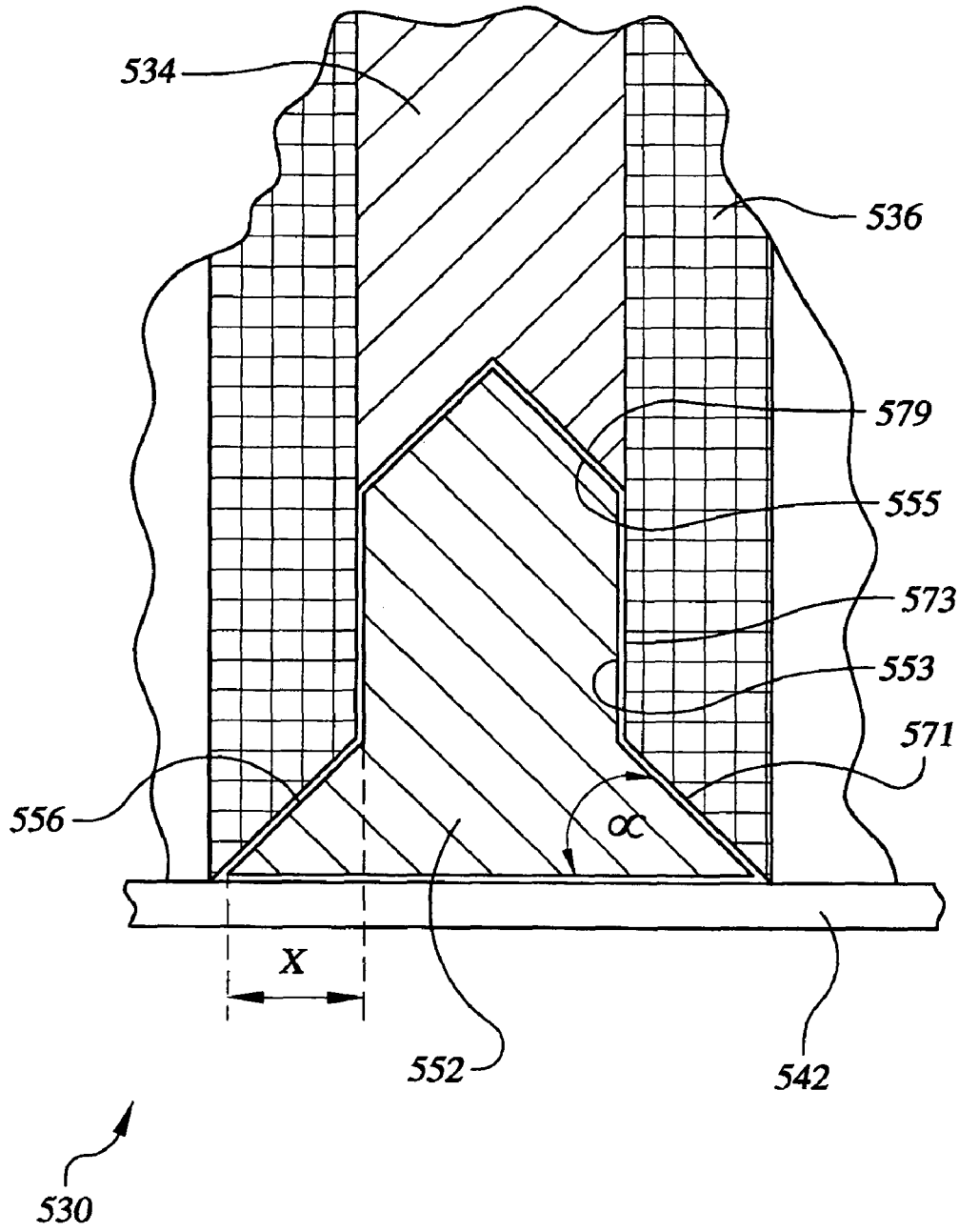
FIG. 11A is a front elevation cross-sectional view of the partition plate, side mortar buffer surface forming area, and filler plug shown in FIGS. 10A and 10B, in accordance with one embodiment of the invention.

FIG. 11A provides a cross sectional front elevation view of some of the components illustrated in FIGS. 10A and 10B. The gussets 536 are secured (e.g., welded, riveted, bolted, etc.) to the interior wall of the mold 530 and to the partition plate 534. In other embodiments, the gussets 536 can be an integral part of the partition plate 534. The gussets 536 and partition plate 534 are configured to conform to the shape of the filler plug 552 (e.g., a tolerance of thousandths of an inch) and to provide for the insertion and removal of the filler plug 552. As shown, the bottom mortar buffer surface forming area 556 clears the bottom surface 571 of the gusset 536, the middle surface 553 clears the side surface 573 of the gusset 556, and the top surface 555 clears the angled bottom surface 579 of the partition plate 534. The bottom mortar buffer surface forming area 556 has an angle ∝ of approximately 30 degrees between the bottom of the filler plug 552 and the bottom mortar buffer surface forming area 556. Such an angle results in a bottom mortar buffer surface angle of inclination between the bottom surface of an ACMU and the front surface of an ACMU of 30 degrees, although a range of angles from 10-60 degrees is contemplated to be within the scope of the preferred embodiments of the invention. Further, the width "X" of the bottom mortar buffer surface forming area 556 is preferably 7/32 inch, although other widths ranging from 1/16 inch-½ inch, or more, are contemplated for other embodiments.

Figure 11B:
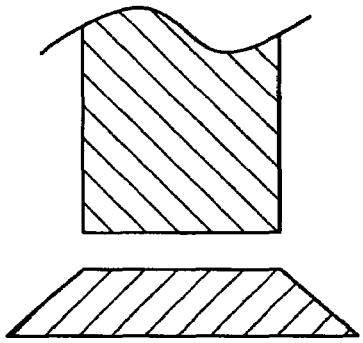
FIGS. 11B-11D are front elevation cross-sectional views of alternate filler plug, partition plate arrangements, in accordance with several embodiments of the invention.
Figure 11C:
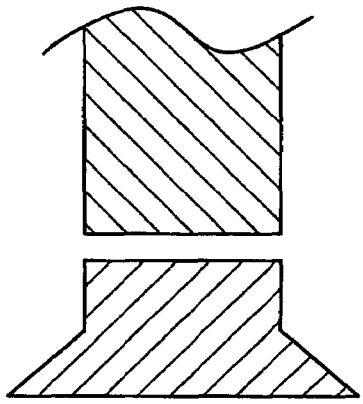
Figure 11D:
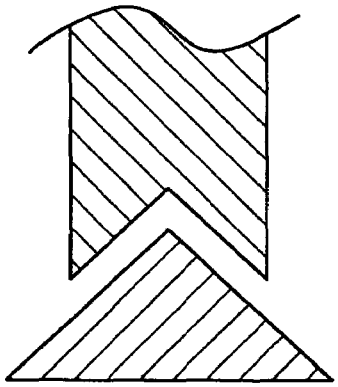

FIGS. 11B-11D show alternate embodiments that illustrate how the filler plug conforms to the partition plate. Preferably, interlocking mating provides greater stability, and in combination with the beveled edges of the filler plug, improves the resistance of the filler plug to breaking during operation. Other geometric shapes and configurations can be used in other embodiments.

Figure 12:
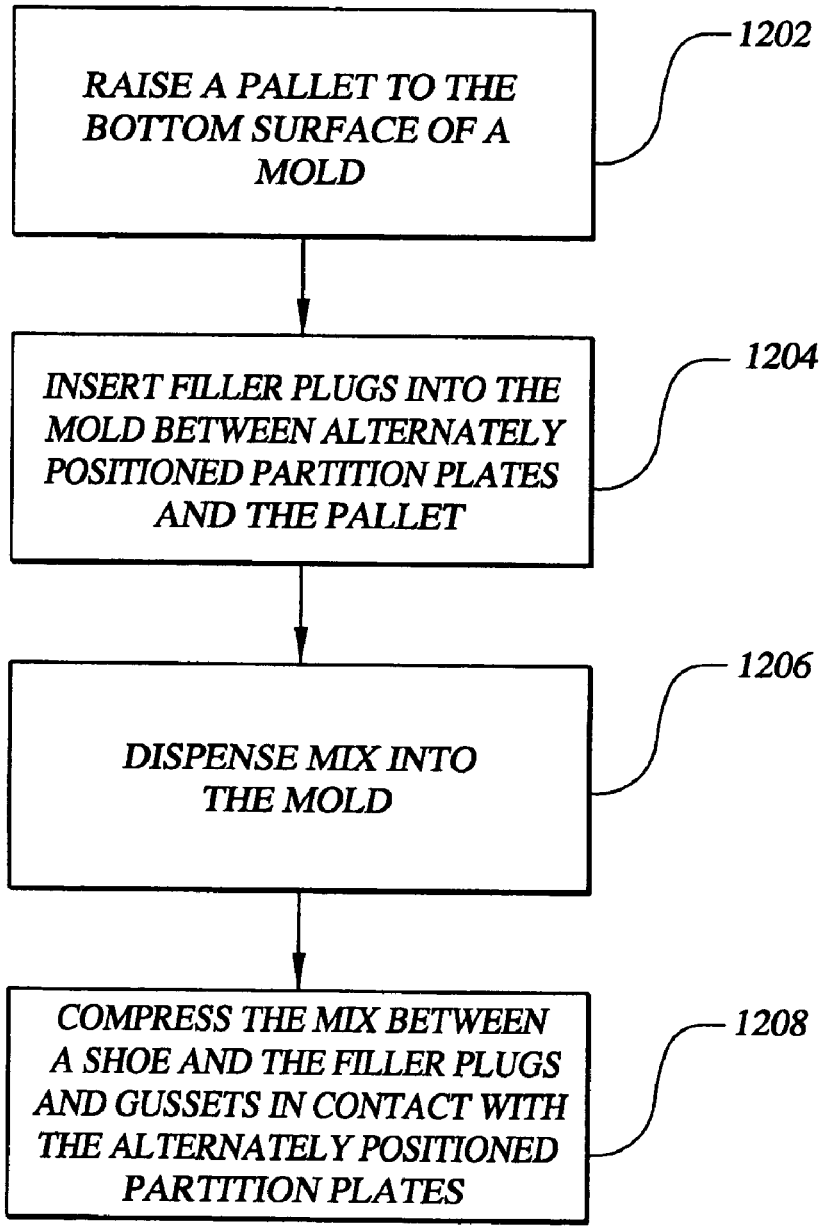
FIG. 12 is a flow chart illustrating select steps of the example ACMU manufacturing method illustrated in FIGS. 4A-4H, in accordance with one embodiment of the invention.

FIG. 12 is a flow chart illustrating select steps of the example ACMU manufacturing method illustrated in FIGS. 4A-4H, in accordance with one embodiment of the invention. Step 1202 includes joining a pallet to the bottom surface of a mold. Step 1204 includes inserting filler plugs into the mold between alternately positioned partition plates and the pallet. Step 1206 includes dispensing mix into the mold. Step 1208 includes compressing the mix between a shoe and the filler plugs and gussets in contact with the alternately positioned partition plates.

It should be noted that in some alternative implementations, the functions noted in the blocks may occur out of the order noted in FIG. 12. For example, two blocks shown in succession in FIG. 12 may in fact be executed substantially concurrently or the blocks may sometimes be executed in the reverse order, depending upon the functionality involved.

Figure 13A:
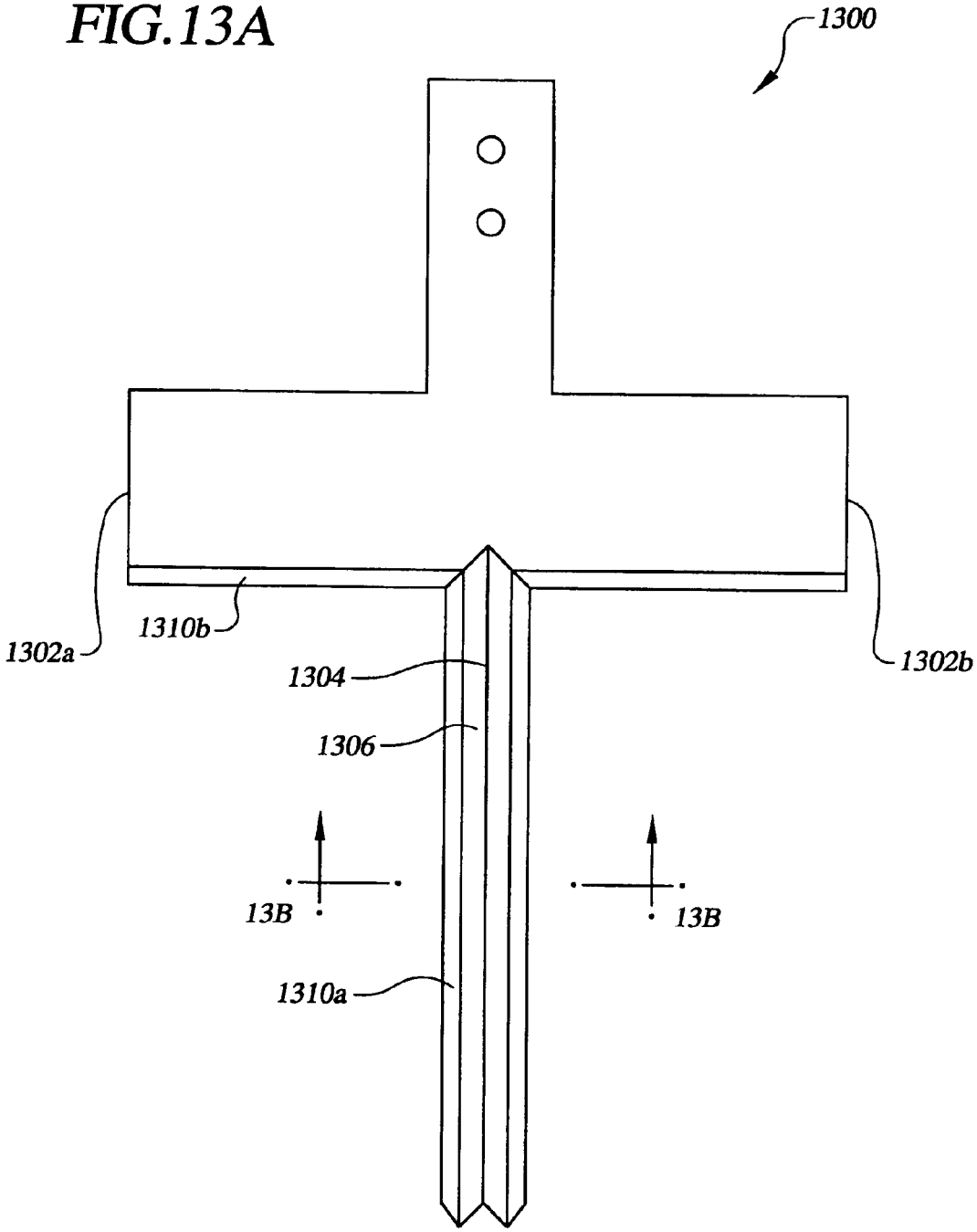
FIG. 13A is a to plan view of an example filler plug for forming a corner ACMU mortar buffer surface, in accordance with one embodiment of the invention.
Figure 13B:
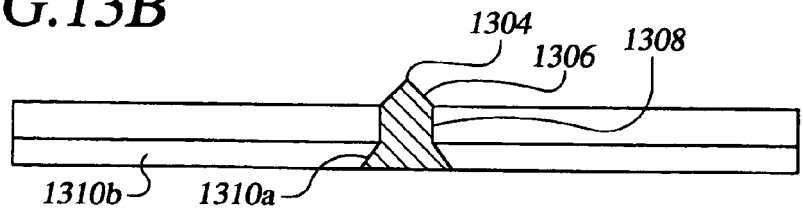
FIG. 13B is a cross-sectional view along line 13B-13B of the example filler plug of FIG. 13A, in accordance with one embodiment of the invention.
Figure 14:
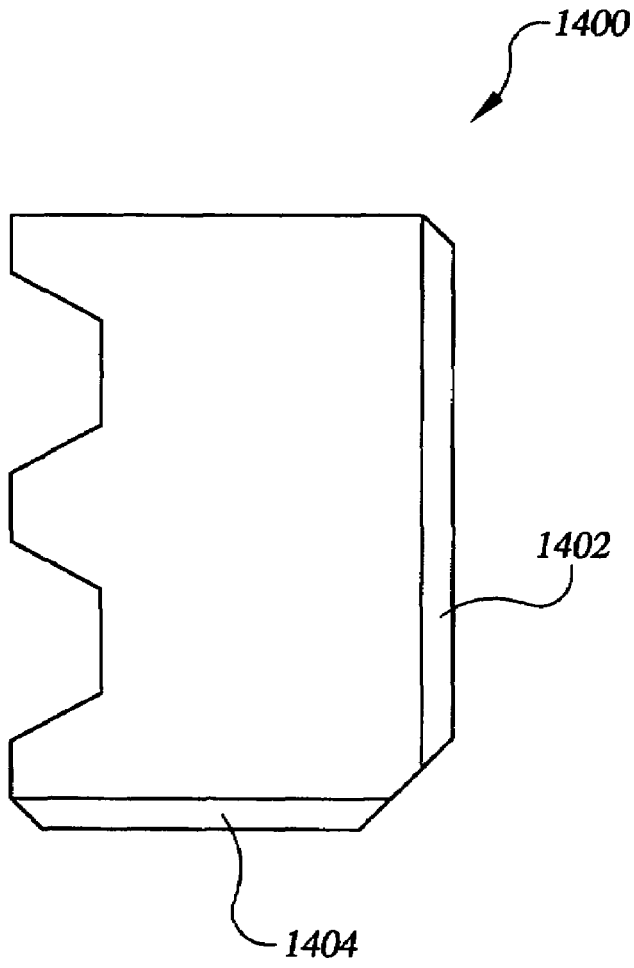
FIG. 14 is a bottom plan view of an example shoe assembly, shown without another cooperating shoe assembly for clarity, used in cooperation with the example filler plug of FIG. 13A to form a corner ACMU mortar buffer surface, in accordance with one embodiment of the invention.

FIGS. 13A-13B generally show various views of an example filler plug for forming bevels (e.g., mortar buffer surfaces) in a corner ACMU for several embodiments. FIG. 13A is a top plan view of the example filler plug 1300. The filler plug 1300 includes a "T" portion 1302*a*, 1302*b*, and otherwise shares similar features to the filler plug 552 shown in FIG. 10A. A portion of the "T" portion 1302 is inserted through and removed from a gap in the side of a mold box during the filler plug insertion/removal steps as described above. Referring to FIG. 13B, with continued reference to FIG. 13A, the filler plug 1300 includes an apex 1304, a top beveled area 1306, a vertical area 1308, a bottom mortar buffer surface forming area 1310*a*, and a corner bottom mortar buffer surface forming area 1310*b* similarly configured to the bottom mortar buffer surface forming area 1310*a*. In one embodiment, the apex 1304 and top beveled area 1306 conformally fit between bottom angled surfaces of a partition plate of a mold box. The vertical area 1308 extends from the top beveled area 1306 to the bottom mortar buffer surface forming area 1310*a*.

FIG. 14 is a bottom plan view of an example shoe assembly, shown without another cooperating shoe assembly for clarity, used in cooperation with the example filler plug of FIG. 13A to form corner ACMU mortar buffer surfaces, in accordance with one embodiment of the invention. The example shoe assembly 1400 includes a top corner mortar buffer surface forming area 1404, in addition to a top mortar buffer surface forming area 1402 similar to that described in association with FIG. 6A. With continued reference to FIG. 13A, the bottom mortar buffer surface forming area 1310*a* and the corner bottom mortar buffer surface forming area 1310*b* form the bottom bevel of an ACMU when the filler plug 1300 is inserted. The top corner mortar buffer surface forming area 1404 and the top mortar buffer surface forming area 1402 form the top corner mortar buffer surface and top (e.g., the beveled edge running along the top exposed face of the ACMU) mortar buffer surface when the shoe assembly 1400 is compressed against the mold mix, in a manner similar to that described above.

Figure 15A:
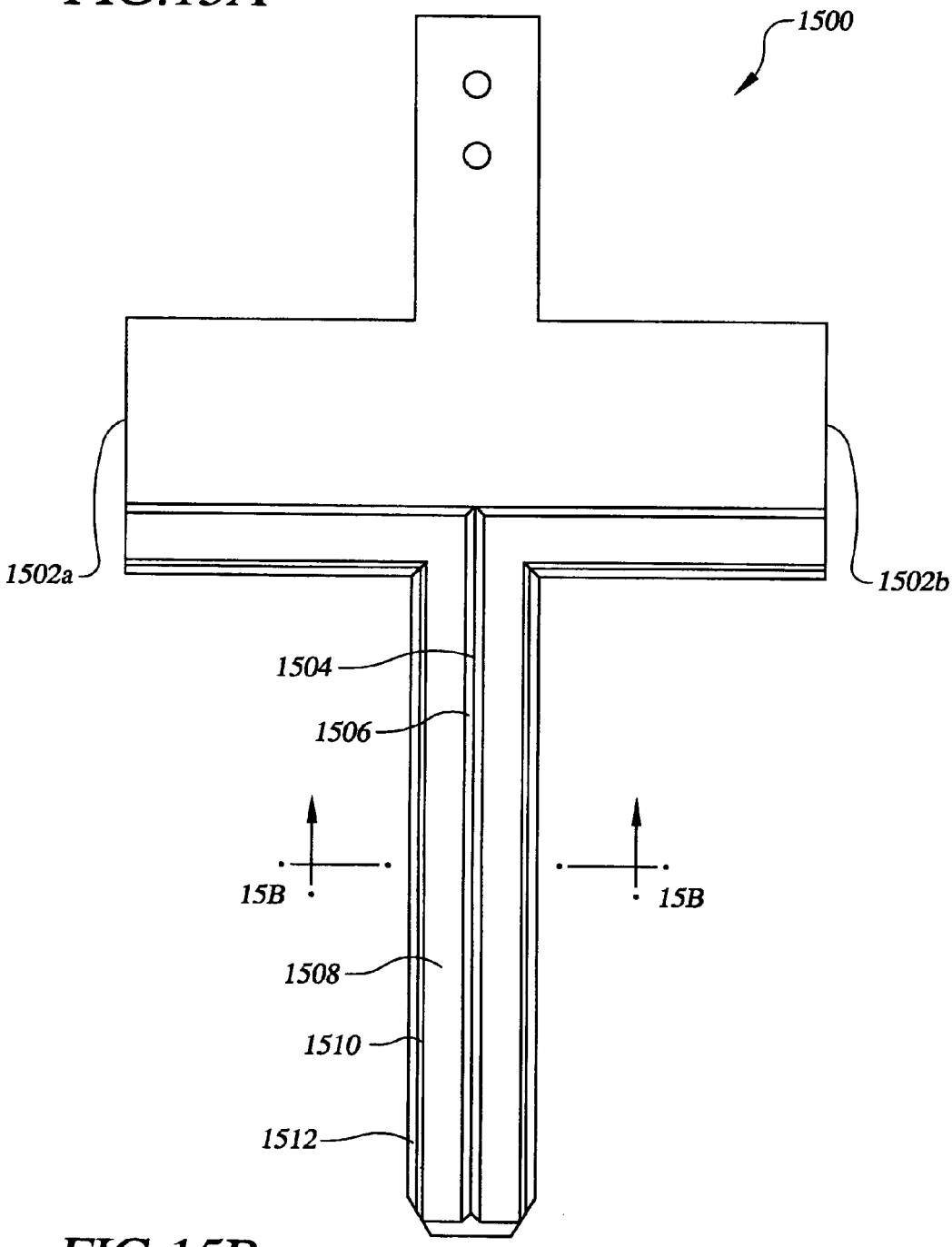
FIG. 15A is a top plan view of an example filler plug for forming beveled areas of a corner segmented retaining wall block, in accordance with one embodiment of the invention.
Figure 15B:
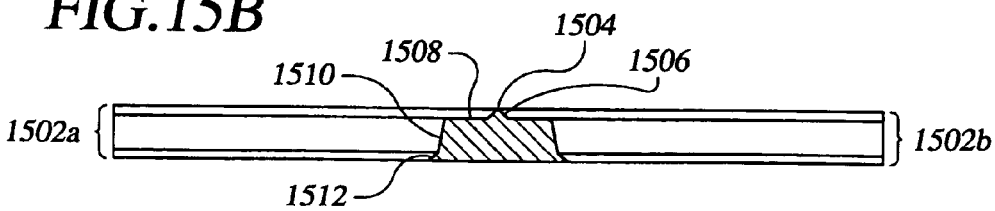
FIG. 15B is a cross-sectional view along line 15B-15B of the example filler plug of FIG. 15A, in accordance with one embodiment of the invention.

FIGS. 15A-15B show various views of an example filler plug for forming beveled surfaces in a corner segmented retaining wall (SRW) block for several embodiments. Referring to FIGS. 15A and 15B, the example filler plug 1500 includes a "T" portion 1502*a*, 1502*b*, an apex portion 1504 and beveled area 1506 that conformally mate with bottom surfaces of a partition plate in a mold box, a first surface forming area 1508 for forming a first bottom surface of a SRW block, a first bevel forming area 1510 for forming a bottom beveled surface of an SRW block, and a second bevel forming area 1512 for forming a second beveled surface on the SRW block.

Also note that references to a conforming fit or snug fit or similar references will be understood to suggest tolerances on the order of thousandths of an inch or better. Further, languages of position, such as front, side, and the like, are done for purposes of example, and are not meant to be limiting.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A method for forming a masonry unit, said method comprising the steps of:

raising a pallet to a bottom surface of a mold;

inserting a filler plug into the side of the mold between a partition plate and a pallet;

dispensing mix into the mold;

compressing the mix with a shoe;

responsive to the compressing, forming a filler plug effect in the compressed mix whereby a masonry unit having a filler plug effect is provided; and responsive to the compressing, forming a substantially constant angle of inclination between a front surface and opposing side surfaces, a top surface, and a bottom surface of the compressed mix corresponding to said masonry unit to be formed by compressing the mix with the shoe against opposing side gussets and the filler plug.

2. The method of claim 1, further including the step of removing the filler plug.

3. The method of claim 1, further including the step of stripping the architectural concrete masonry unit from the mold by lowering the pallet.

4. The method of claim 1, wherein the step of forming includes forming a bottom bevel in the compressed mix such that a masonry unit with a bottom bevel is formed.

5. The method of claim 1, wherein the step of forming includes forming a mortar buffer surface in the compressed mix such that a masonry unit with a mortar buffer surface is formed.

6. The method of claim 1, wherein compressing the mix with the shoe against opposing side gussets and the filler plug includes compressing the mix with an angular surface of the shoe against an angular surface of the opposing side gussets and an angular surface of the filler plug.

7. The method of claim 6, wherein the compressing the mix with an angular surface of the shoe against an angular surface of the opposing side gussets and an angular surface of the filler plug includes forming the filler plug effect in the compressed mix with an approximately 30 degree angled surface referenced from a bottom surface of the filler plug.

8. The method of claim 6, wherein compressing the mix with an angular surface of the shoe against an angular surface of the opposing side gussets and an angular surface of the filler plug includes forming the filler plug effect in the compressed mix with an angular range of approximately 10-60 degrees, the range referenced from a bottom surface of the filler plug.

9. The method of claim 6, wherein compressing the mix with an angular surface of the shoe against an angular surface of the opposing side gussets and an angular surface of the filler plug includes forming the filler plug effect in the compressed mix with a width of approximately 7/32 inch.

10. The method of claim 6, wherein compressing the mix with an angular surface of the shoe against an angular surface of the opposing side gussets and an angular surface of the filler plug includes forming the filler plug effect in the compressed mix with a width in the range of approximately 1/16 inch-½ inch.

11. The method of claim 6, wherein compressing the mix with an angular surface of the shoe against an angular surface of the opposing side gussets and an angular surface of the filler plug includes forming the angular surface between the front and top surfaces of the compressed mix with an angle of approximately 30 degrees.

12. The method of claim 6, wherein compressing the mix with an angular surface of the shoe against an angular surface of the opposing side gussets and an angular surface of the filler plug includes forming the angular surface between the front and top surfaces of the compressed mix with an angle in a range of approximately 10-60 degrees.

13. The method of claim 6, wherein compressing the mix with an angular surface of the shoe against an angular surface of the opposing side gussets and an angular surface of the filler plug includes forming the angular surface between the front and top surfaces of the compressed mix with a width in the range of approximately 1/16 inch-½ inch.

14. The method of claim 6, wherein compressing the mix with an angular surface of the shoe against an angular surface of the opposing side gussets and an angular surface of the filler plug includes forming the angular surface between the front and top surfaces of the compressed mix with a width of approximately 7/32 inch.

15. The method of claim 6, wherein compressing the mix with an angular surface of the shoe against an angular surface of the opposing side gussets and an angular surface of the filler plug includes forming the angled surface between the front and side surfaces of the compressed mix with an angle of approximately 30 degrees.

16. The method of claim 6, wherein compressing the mix with an angular surface of the shoe against an angular surface of the opposing side gussets and an angular surface of the filler plug includes forming the angled surface between the front and side surfaces of the compressed mix with an angle in a range of approximately 120-170 degrees.

17. The method of claim 6, wherein compressing the mix with an angular surface of the shoe against an angular surface of the opposing side gussets and an angular surface of the filler plug includes forming the angled surface between the front and side surfaces of the compressed mix with a width in the range of approximately 1/16 inch-½ inch.

18. The method of claim 6, wherein compressing the mix with an angular surface of the shoe against an angular surface of the opposing side gussets and an angular surface of the filler plug includes forming the angled surface between the front and side surfaces of the compressed mix with a width of approximately 7/32 inch.

19. The method of claim 1, wherein the step of inserting a filler plug includes the step of inserting a plurality of filler plugs substantially simultaneously.

20. The method of claim 1, further including forming a bottom corner bevel in the compressed mix corresponding to at least one of a segmented retaining wall block, a concrete masonry unit, and an architectural concrete masonry unit by using a "T" portion of the filler plug, the "T" portion having a beveled surface.

21. A method for forming masonry units, said method comprising the steps of:

raising a pallet to contact a bottom surface of a mold having gussets connected to internal surfaces of the mold;

inserting a plurality of filler plugs substantially simultaneously into the side of the mold between a plurality of partition plates and the pallet;

dispensing mix into the mold;

compressing the mix with a shoe; and responsive to the compressing, forming a plurality of beveled-edge surfaces on the compressed mix corresponding to a masonry unit, the beveled-edge surfaces joining a front surface to a top surface, a bottom surface, and side surfaces.

* * * * *